US008922307B2

(12) United States Patent
Fujimoto et al.

(10) Patent No.: US 8,922,307 B2
(45) Date of Patent: Dec. 30, 2014

(54) ELECTROMAGNETIC RELAY

(71) Applicant: Omron Corporation, Kyoto-shi, Kyoto (JP)

(72) Inventors: Koji Fujimoto, Yamaga (JP); Akifumi Fujino, Kikuchi (JP); Bin Wang, Shanghai (CN); Kaori Hirano, Yamaga (JP); Ayumi Noguchi, Yatsushiro (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 13/859,640

(22) Filed: Apr. 9, 2013

(65) Prior Publication Data

US 2013/0293324 A1 Nov. 7, 2013

(30) Foreign Application Priority Data

Apr. 9, 2012 (JP) ..... 2012-088549

(51) Int. Cl.

| | |
|---|---|
| ***H01H 51/22*** | (2006.01) |
| ***H01H 67/02*** | (2006.01) |
| ***H01H 9/48*** | (2006.01) |
| ***H01H 50/02*** | (2006.01) |
| ***H01H 50/24*** | (2006.01) |
| ***H01H 50/64*** | (2006.01) |

(52) U.S. Cl.

CPC ..... *H01H 9/48* (2013.01); *H01H 50/026* (2013.01); *H01H 50/24* (2013.01); *H01H 50/64* (2013.01); *H01H 51/2236* (2013.01); *H01H 51/229* (2013.01)

USPC ..... 335/78; 335/129

(58) Field of Classification Search

CPC .... H01H 50/58; H01H 50/642; H01H 50/641

USPC ..... 335/78, 129, 4

See application file for complete search history.

(56) References Cited

U.S. PATENT DOCUMENTS

| | | | | |
|---|---|---|---|---|
| 4,258,344 | A * | 3/1981 | Nishimi | 335/129 |
| 5,204,647 | A * | 4/1993 | Mitsuki et al. | 335/80 |
| 5,699,030 | A * | 12/1997 | Leikus et al. | 335/4 |
| 6,252,478 | B1 * | 6/2001 | Gruner | 335/78 |
| 6,545,575 | B1 * | 4/2003 | Hirabayashi et al. | 335/78 |
| 7,872,551 | B2 * | 1/2011 | Nakamura et al. | 335/4 |

FOREIGN PATENT DOCUMENTS

| | | |
|---|---|---|
| DE | 3938226 | 11/1989 |
| EP | 0049088 | 4/1982 |
| EP | 1298691 | 4/2003 |
| EP | 2226827 | 9/2010 |
| JP | 2003-115248 A | 4/2003 |

* cited by examiner

*Primary Examiner* — Alexander Talpalatski

(74) *Attorney, Agent, or Firm* — Blakely Sokoloff Taylor & Zafman

(57) ABSTRACT

An electromagnetic relay includes an electromagnetic part, a movable iron piece, a contact driving part, a contact which is opened and closed by driving the contact driving part with a card disposed between the movable iron piece and the contact driving part. Particularly, the card is disposed between the insulating wall and the contact driving part, a driving projection projected onto an inward surface side opposed to the insulating wall of the card is inserted in and projected from a manipulation hole made in the insulating wall, and the driving projection of the card is pressed by the movable iron piece that is operated based on excitation and demagnetization of the electromagnetic part.

7 Claims, 25 Drawing Sheets

ELECTROMAGNETIC RELAY

BACKGROUND OF THE INVENTION

1. Technical Field

The present invention relates to an electromagnetic relay.

2. Related Art

Conventionally, Japanese Unexamined Patent Publication No. 2003-115248 discloses an electromagnetic relay. The electromagnetic relay includes: a substantially C-shaped flat-plate yoke that includes a body part extending in a horizontal direction and leg parts extending downward from both ends of the body part; an insulating winding frame that includes a winding body part attached to the body part, and an exciting coil being wound around the winding body part; an armature that includes a horizontal part, a turning shaft part, and a vertical part, the horizontal part extending in the horizontal direction, an insulating actuating piece being provided in the horizontal part, the turning shaft part extending from one end side of the horizontal part toward an extending direction of one of the leg parts, the vertical part extending from the other end side of the horizontal part, the vertical part coming into contact with the other leg part when the exciting coil is excited; an insulating base housing that includes a recessed portion or a hole while supporting the leg parts of the yoke, the recessed portion or the hole receiving a shaft piece formed at a lower end of the turning shaft part of the armature; and a movable contact piece and a fixed contact piece that are attached to the base housing while disposed below the exciting coil and between the leg parts of the yoke, the movable contact piece and the fixed contact piece coming into contact with each other by a pressing force of the actuating piece. In the electromagnetic relay, the base housing includes an insulating wall extending between the exciting coil and the armature and a second insulating wall that interrupts the movable and fixed contact pieces and the armature, and the actuating piece presses the movable contact piece through a hole made in a substantially central portion of the second insulating wall.

As illustrated in FIG. 6, in the conventional electromagnetic relay, an armature 60 reciprocatably turned by excitation and demagnetization of an exciting coil 56 and an actuating piece (card) 64 are integrally reciprocated, a movable contact piece 21 is driven by the actuating piece 64 to bring and separate the movable contact into contact with and from the fixed contact.

However, in the conventional electromagnetic relay, it is necessary to obliquely assemble a projection part 65 of the actuating piece 64 outsert-molded in the armature 60 in a rectangular hole 15 made in a base 10. For this reason, it is troublesome to assemble the projection part 65 in the rectangular hole 15, which results in low assembly workability. Additionally, it is necessary to make the rectangular hole 15 in large size. Therefore, a desired insulating distance cannot be ensured, and an insulating characteristic is degraded. It is also necessary to make the rectangular hole 15 in large size compared with a section of the projection part 65, which results in a problem in that an abrasion powder generated by an operation of the armature 60 easily passes through the rectangular hole 15 to generate an insulation failure. The present invention has been devised to solve the problems described above, and an object thereof is to provide an electromagnetic relay having the excellent assembly workability, the excellent insulating characteristic, and the hard-to-generate insulation failure.

SUMMARY OF THE INVENTION

In accordance with one aspect of the present invention, an electromagnetic relay comprises of an electromagnetic part, a movable iron piece, a contact driving part, a contact selectively openable and closeable by driving the contact driving part with a card disposed between the movable iron piece and the contact driving part, a driving projection insertable into a manipulation hole made in an insulating wall projecting from an upper surface of a base wherein the electromagnetic part and the movable iron piece are disposed on one of side of the insulating wall and the contact driving part is disposed on the other side of the insulating wall. Further, the card is disposed between the insulating wall and the contact driving part and the driving projection of the card is pressed by the movable iron piece operable based on excitation and demagnetization of the electromagnetic part.

According to another aspect of the present invention, the card is not integral with the movable iron piece, but a degree of freedom of assembly work increases. Therefore, it is not necessary to make the manipulation hole in a large size. For this reason, not only the assembly workability is improved, but also the desired insulating distance can be ensued. Therefore, the electromagnetic relay having the excellent insulating characteristic is obtained. Additionally, because it is not necessary to largely make the manipulation hole in a large size, the abrasion powder hardly passes through the manipulation hole, and the electromagnetic relay having the hard-to-generate the insulation failure is obtained.

In a preferred embodiment of the present invention, a looped rib may be provided in an opening edge portion of the manipulation hole on the other side of the insulating wall. Accordingly, the distance along the surface is lengthened to improve the insulating characteristic.

In another preferred embodiment of the present invention, a looped groove portion may be formed on the inward surface side of the card, wherein said looped groove portion is fixable in the looped rib. Accordingly, the distance along the surface is further lengthened to improve the insulating characteristic, and the abrasion powder hardly passes through the manipulation hole. Therefore, the insulation failure is hardly generated.

In still another preferred embodiment of the present invention, insulating ribs may be provided in an upper and a lower edge portions on an outward surface side that is located on an opposite side to the insulating wall of the card. Accordingly, an insulating distance is lengthened by the insulating rib of the card, and the electromagnetic relay having the good insulating characteristic is obtained.

In yet another preferred embodiment of the present invention, a guide groove that can be fitted in a support projection projecting from the insulating wall of the base may be provided in one of the edge portion of the card. Accordingly, because the card is guided by the support projection, card positioning accuracy is improved, and the electromagnetic relay in which a variation of an operating characteristic is eliminated is advantageously obtained.

DETAILED DESCRIPTION OF THE PREFERRED EMBODIMENTS

Figure 1A:
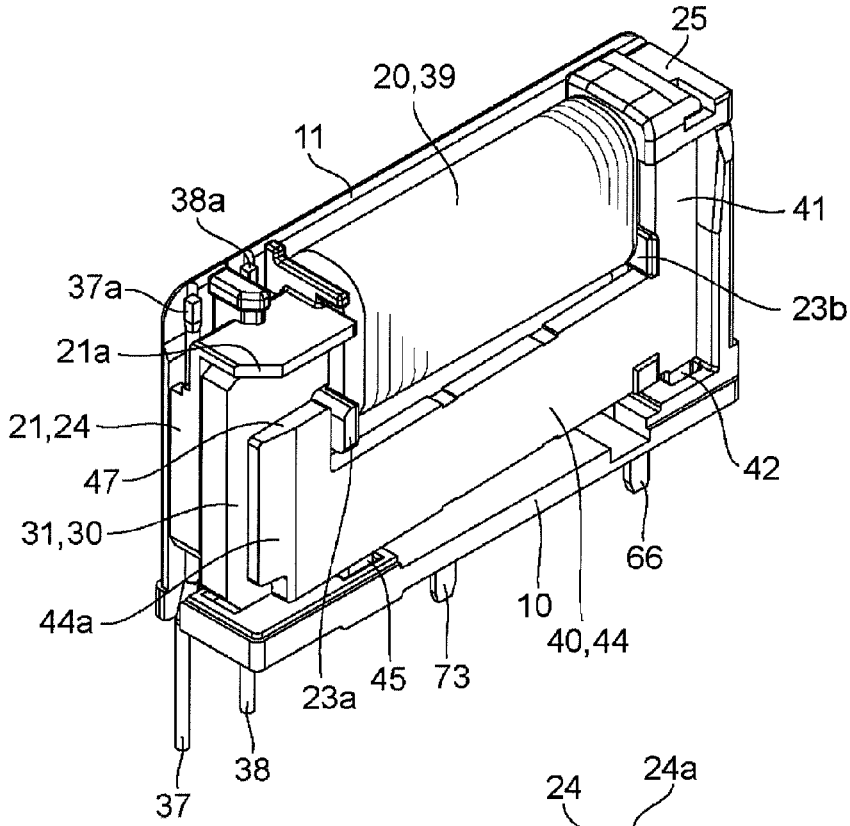
FIGS. 1A and 1B are perspective views illustrating an electromagnetic relay according to a first embodiment of the present invention from different angles.
Figure 1B:
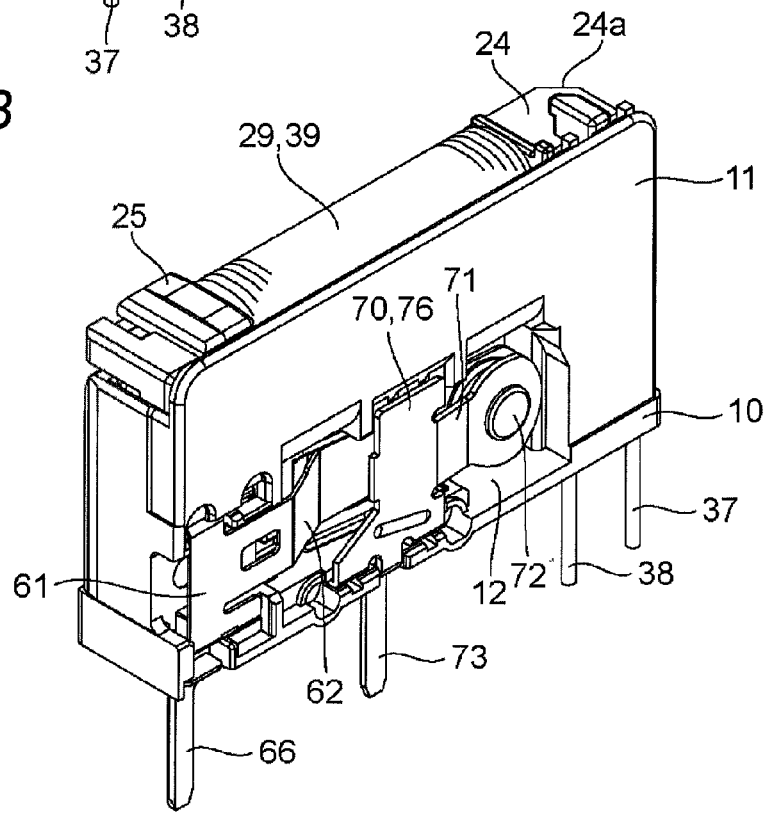

An electromagnetic relay according to an exemplary embodiment of the present invention will be described below with reference to FIGS. 1 to 25. As illustrated in FIGS. 1 to 18, an electromagnetic relay according to the first embodiment preferably includes a base 10, an electromagnetic part 20, a movable iron piece 40, a card 50, a contact driving part 60, and a case 80. For the sake of convenience, the case 80 is not illustrated in FIG. 1. Further, it is assumed that a front surface side (FIG. 2) is a side where the electromagnetic part 20 is assembled on the base 10, and a rear surface side (FIG. 3) is a side where the contact driving part 60 is assembled on the base 10.

Figure 8A:
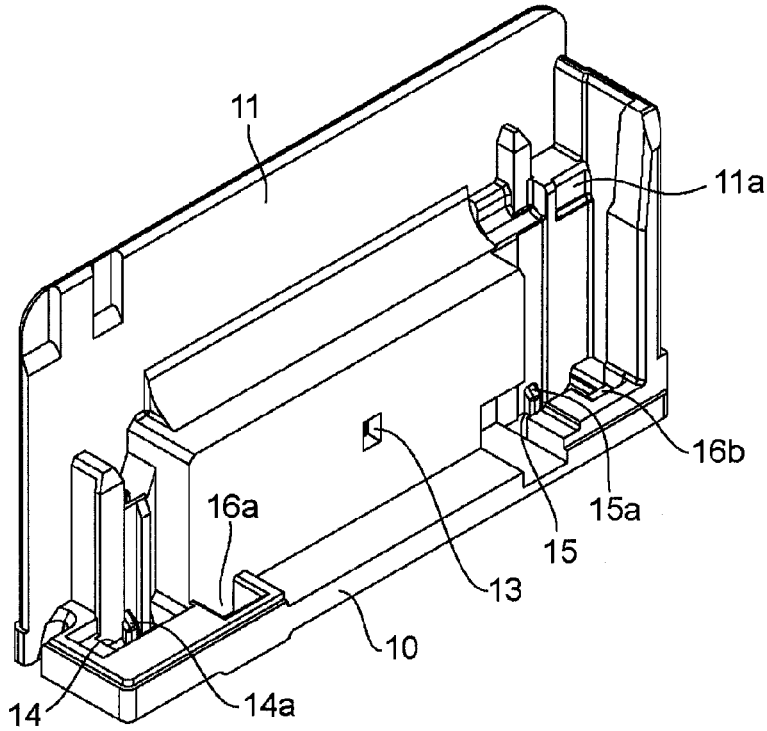
FIGS. 8A and 8B are perspective views of a base from different angles.
Figure 8B:
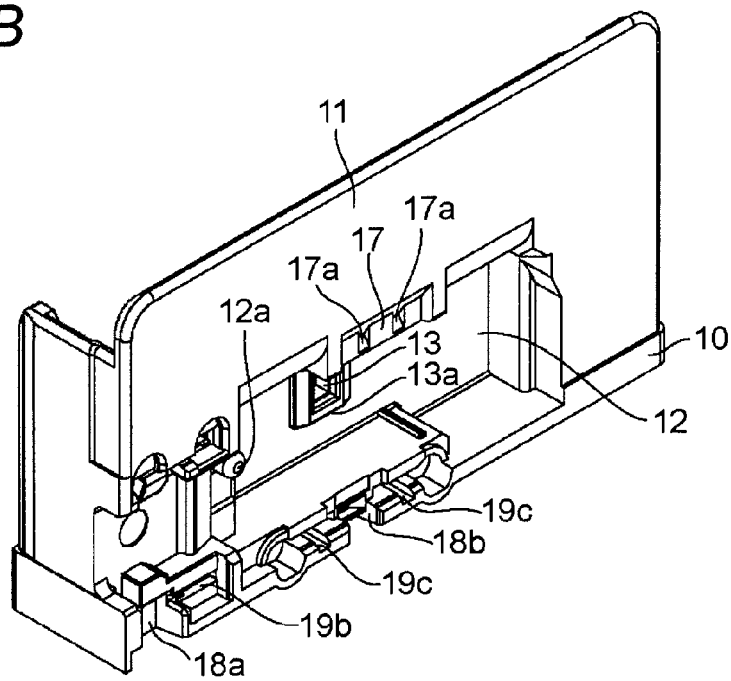
Figure 9A:
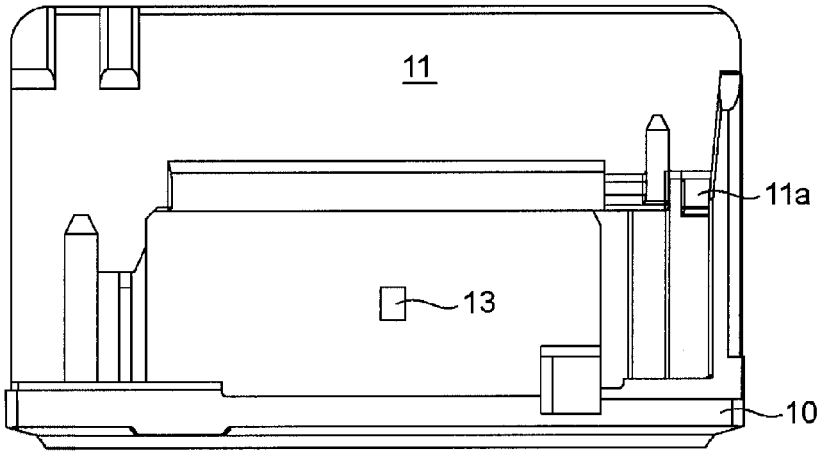
FIG. 9A is a front view of the base.

As illustrated in FIGS. 8 and 9, on an upper surface of an outer circumferential edge portion of the base 10, an insulating wall 11 having a substantial L-shape in a planar view is integrally molded along adjacent sides. Further, the insulating wall 11 is partially expanded on to a front surface side of the base 10 to form a recess 12, wherein the contact driving part 60 may be disposed which will be described later in detail. Also, a square-shaped manipulation hole 13 is made in a substantially central portion of the recess 12, wherein a manipulation projection 52 of the card 50 may be inserted.

Figure 9B:
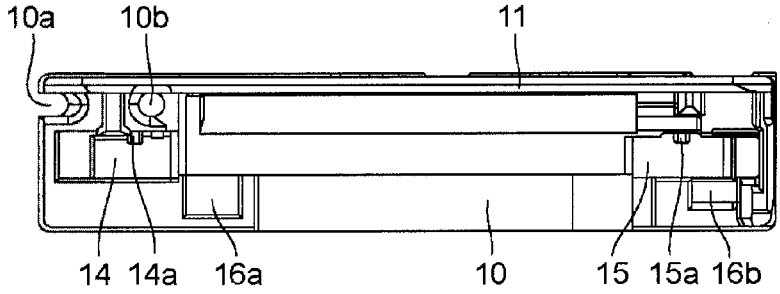
FIG. 9B is a plan view of the base.

As illustrated in FIG. 9B, in the base 10, a pair of press-fitting recessed portions 14 and 15 is provided near a base portion on the front surface side of the insulating wall 11 in order to assemble the gate type iron core 30 which will be described later in detail. Further, crush projections 14*a* and 15*a* are provided in base portion on inside surfaces of the press-fitting recessed portions 14 and 15, respectively. A retaining hole 16*a* is provided adjacent to the press-fitting recessed portion 14 in order to retain the movable iron piece 40 which will be described later in detail, and a bearing part 16*b* is provided adjacent to the press-fitting recessed portion 15 in order to support the movable iron piece 40. A terminal notch part 10*a* and a terminal hole 10*b* are provided between the press-fitting recessed portion 14 and the insulating wall 11 in order to insert coil terminals 37 and 38 which will be described later in detail.

Figure 9C:
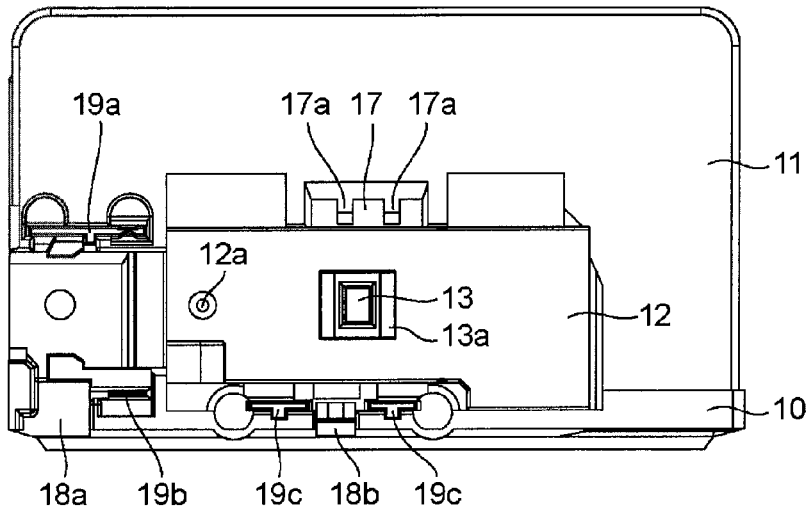
FIG. 9C is a rear view of the base.

As illustrated in FIG. 9C, in the base 10, the square-shaped manipulation hole 13 is made in the substantially central portion of the recess 12 provided on the rear surface side of the insulating wall 11. Further, a looped rib 13*a* is provided around the manipulation hole 13, and a support projection 12*a* is projected adjacent to the manipulation hole 13. In the outer circumferential edge portion of the base 10, a movable contact terminal notch part 18*a* and a fixed contact terminal notch part 18*b* are provided in a region located in an opening edge portion of the recess 12. In the insulating wall 11, a fixed contact terminal positioning step part 17, having a tapered surface, is formed in a region located in the opening edge portion of the recess 12. Also, seal reservoir parts 17*a* (FIG. 7C) are provided, in parallel, in a back-side corner portion of the positioning step part 17, and each of the seal reservoir part 17*a* is formed by tapered surfaces and has a substantially triangular shape in section. In the base 10, press fit grooves 19*a* and 19*b* are provided adjacent to the recess 12, and press fit grooves 19*c* and 19*c* are provided on both sides of the fixed contact terminal notch part 18*b*.

Figure 10A:
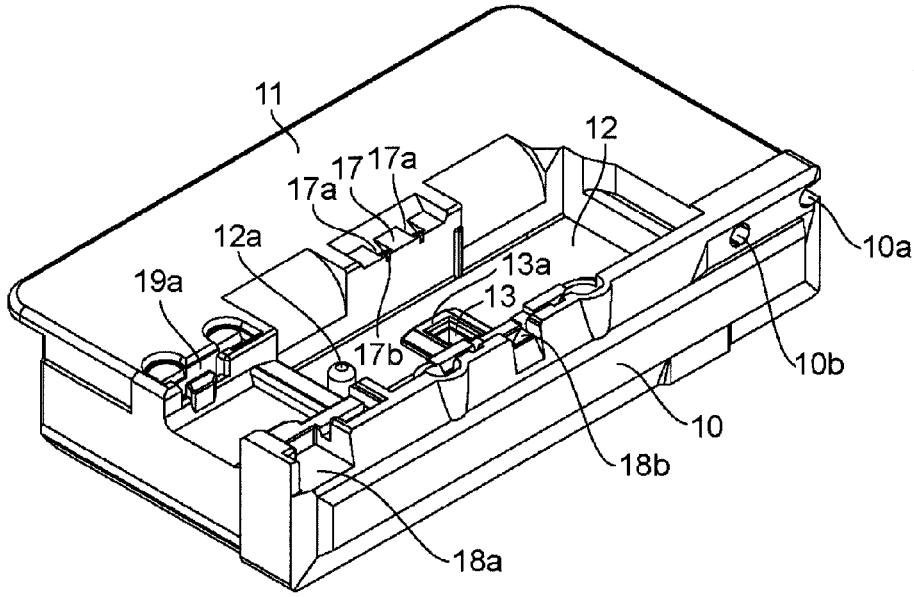
FIG. 10A is a perspective view illustrating a modification of the base in FIG. 1.
Figure 10B:
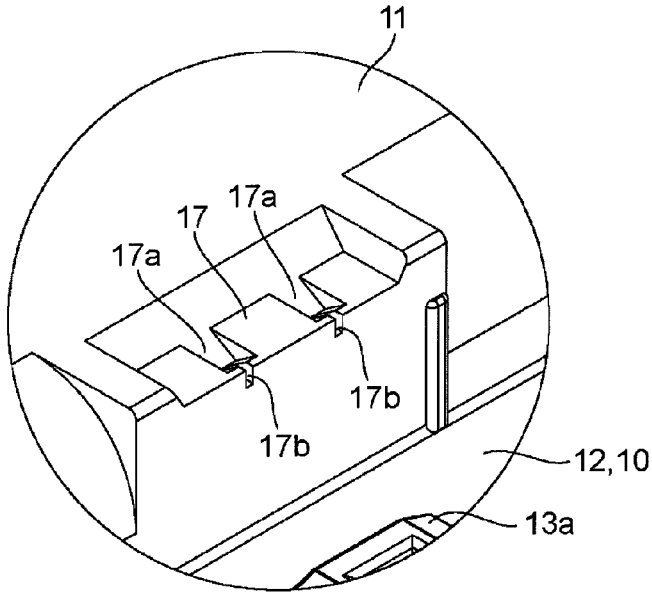
FIG. 10B is a partially enlarged view of the base as shown in FIG. 10A.

As illustrated in FIGS. 10A and 10B, a vent groove 17*b* may be communicated with the seal reservoir part 17*a* in order to easily and surely inject a seal material (not illustrated for sake of brevity).

Figure 11A:
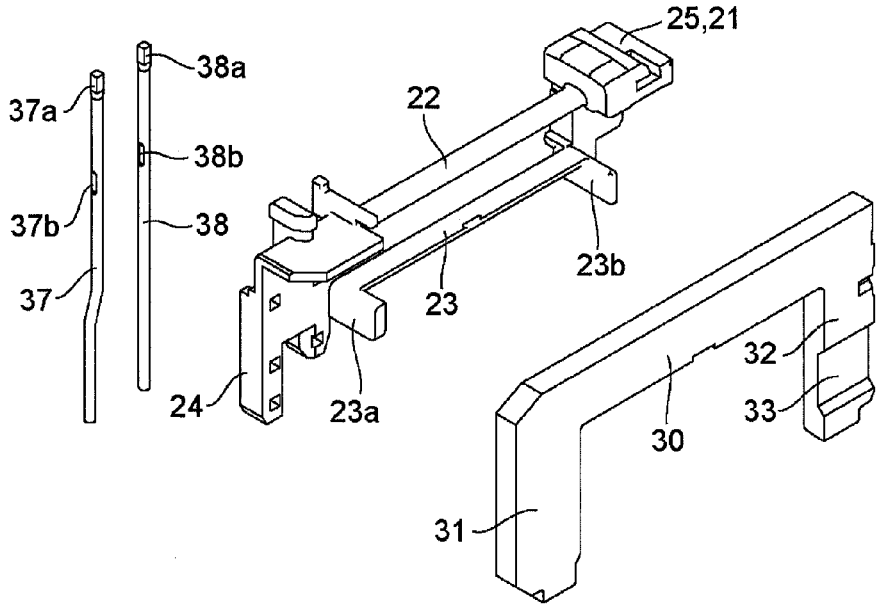
FIGS. 11A and 11B are exploded perspective views of an electromagnetic part from different angles.

As illustrated in FIG. 11A, the electromagnetic part 20 is configured such that a coil 39 is wound around the electromagnetic part 20 while the gate type iron core 30 and the pair of coil terminals 37 and 38 are assembled in a spool 21.

Figure 11B:
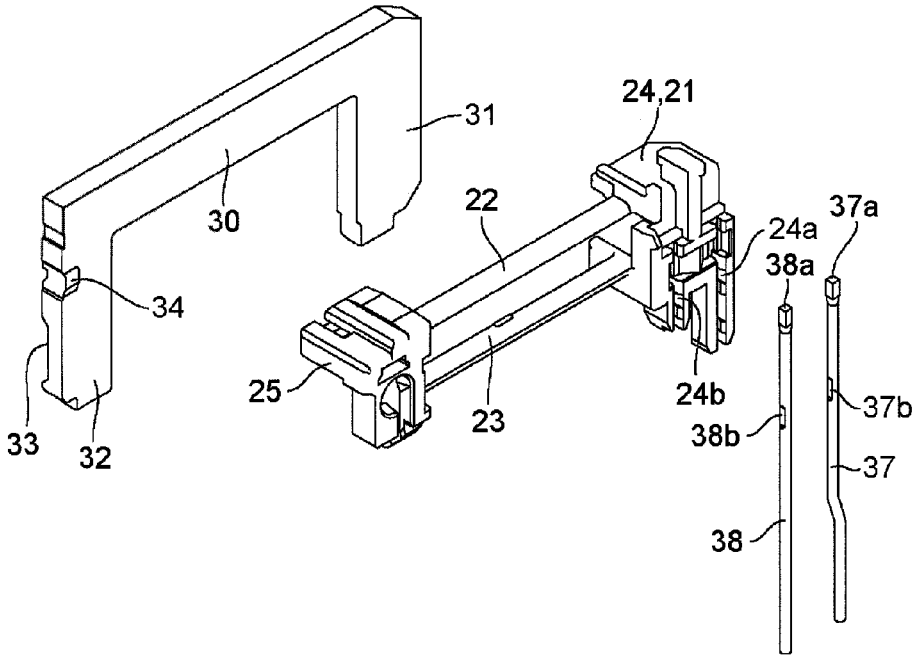
Figure 12A:
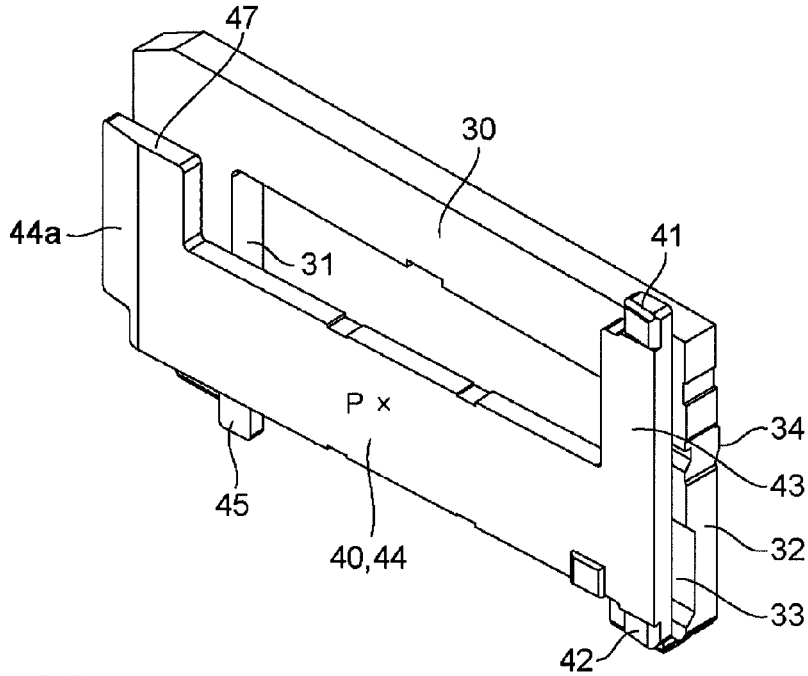
FIGS. 12A and 12B are perspective views illustrating a state in which a movable iron piece is assembled in an iron core from different angles.
Figure 12B:
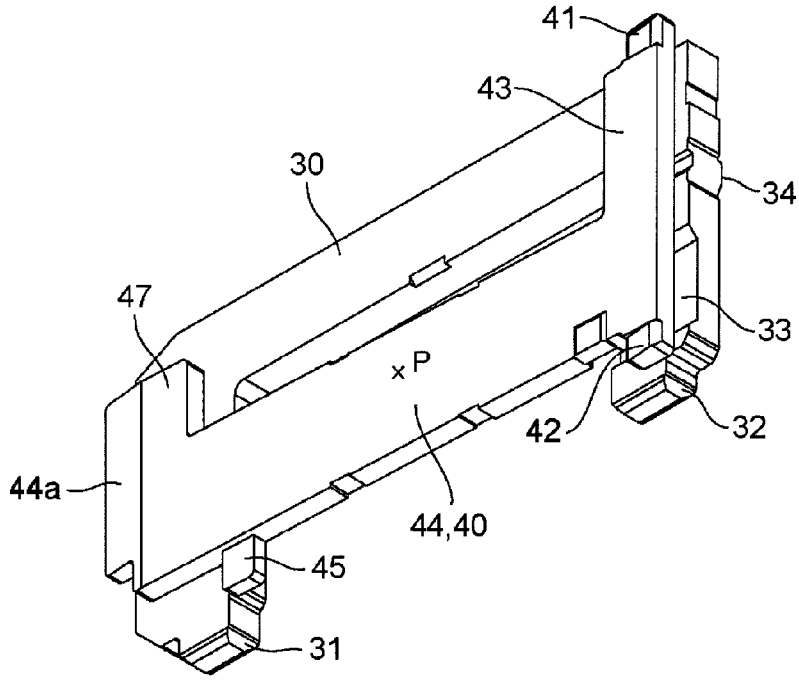

Further, in the spool 21, a pair of guard portions 24 and 25 is integrally coupled by a pair of parallel rod-shaped coupling members 22 and 23. Also, arm parts 23*a* and 23*b* laterally project at both ends of the rod-shaped coupling member 23 in order to retain the gate type iron core 30. As illustrated in FIG. 11B, press fit grooves 24*a* and 24*b* are provided in parallel on the rear surface side of the guard portion 24 in order to press-fit and retain the coil terminals 37 and 38. Substantially triangular retaining projected threads (not illustrated) are provided along a shaft center direction in opposed surfaces of the press fit grooves 24*a* and 24*b*.

As illustrated in FIG. 11A, the gate type iron core 30 is formed by punching a plate-like magnetic material into a gate type, and leg parts 31 and 32 are provided on both sides of the gate type iron core 30. In the leg part 32, a shallow groove 33 is formed in a lower portion on the front surface side in order to reduce magnetic flux density, and a protrusion 34 is provided so as to be protruded toward the rear surface side from an outside edge portion of the leg part 32.

Figure 5A:
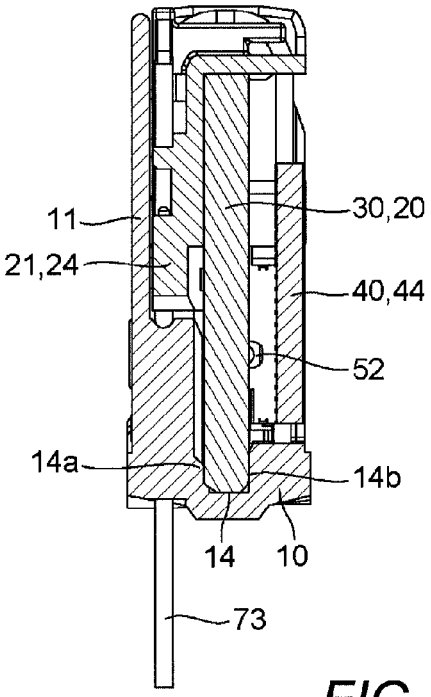
FIG. 5A is a sectional view of a left side surface of the electromagnetic relay as shown in FIGS. 1A and 1B.
Figure 5B:
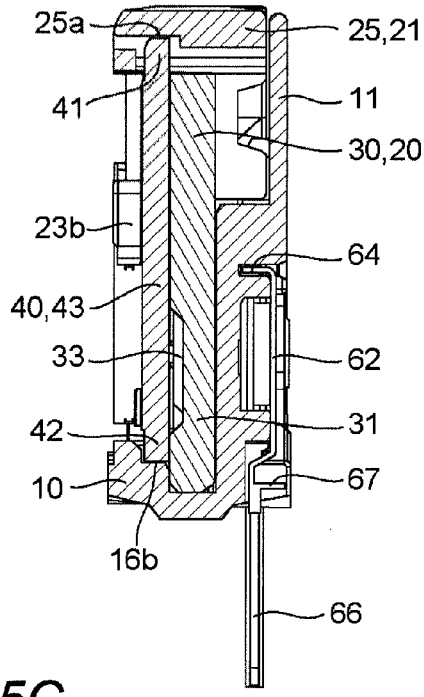
FIG. 5B is a sectional view of a right side surface of the electromagnetic relay as shown in FIGS. 1A and 1B.

The part which reduces the magnetic flux density may be provided on one of or both the surfaces opposed to the leg part 32 of the gate type iron core 30 and a turning shaft part 43 of the movable iron piece 40 (FIG. 5B). Particularly, the part that reduces the magnetic flux density is preferably provided below a line connecting a shaft part 41 of the movable iron piece 40 (FIG. 5B) and a pressing point P of a manipulation projection 52 of the card 50 which will be described later in detail.

As illustrated in FIGS. 11A and 11B, the coil terminals 37 and 38 are formed into a pin shape having a circular shape in section, tying-up parts 37*a* and 38*a* having a rectangular shape in section are formed in upper end portions of the coil terminals 37 and 38, and whirl-stop parts 37*b* and 38*b* having a square shape in section are provided by press working in intermediate portions of the coil terminals 37 and 38. The tying-up parts 37*a* and 38*a* may be formed in, but not limited to, quadrangle, rectangular, a triangle, and an ellipse section Preferably the tying-up parts 37*a* and 38*a* may have a shape including a corner portion that can cut the coil 39.

The gate type iron core 30 is assembled in the arm part 23*a* and 23*b* of the spool 21, and the coil terminals 37 and 38 are press-fitted in the press fit grooves 24*a* and 24*b* of the guard portion 24, and engaged with and fixed to the retaining projected threads provided in the press fit grooves 24*a* and 24*b*. After the tying-up parts 37*a* and 38*a* of the coil terminals 37 and 38 are laterally bent, the coil 39 is wound around the rod-shaped coupling members 22 and 23 and the gate type iron core 30. A lead of the coil 39 is tied up to the tying-up parts 37*a* and 38*a* of the coil terminals 37 and 38, the coil 39 is cut by the corner portions of the tying-up parts 37*a* and 38*a*, and the coil 39 and the tying-up parts 37*a* and 38*a* are bonded by soldering. Then the tying-up parts 37*a* and 38*a* are bent and raised to complete the electromagnetic part 20. The assembly of the electromagnetic part 20 in the base 10 will be described later because the assembly of the electromagnetic part 20 needs to be performed at the same time as the movable iron piece 40.

Figure 2:
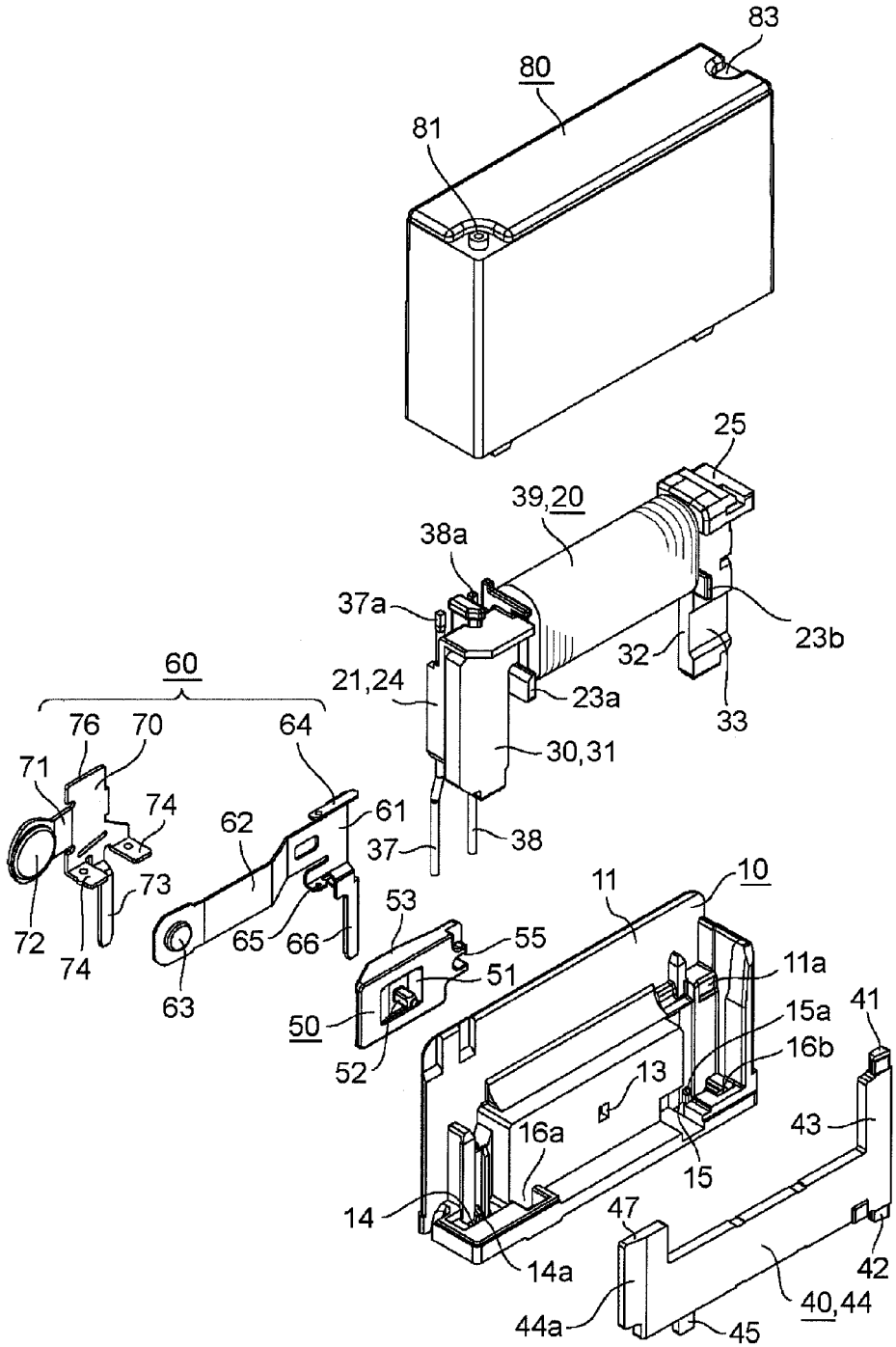
FIG. 2 is an exploded perspective view illustrating the electromagnetic relay from the same viewpoint as shown in FIG. 1A.
Figure 3:
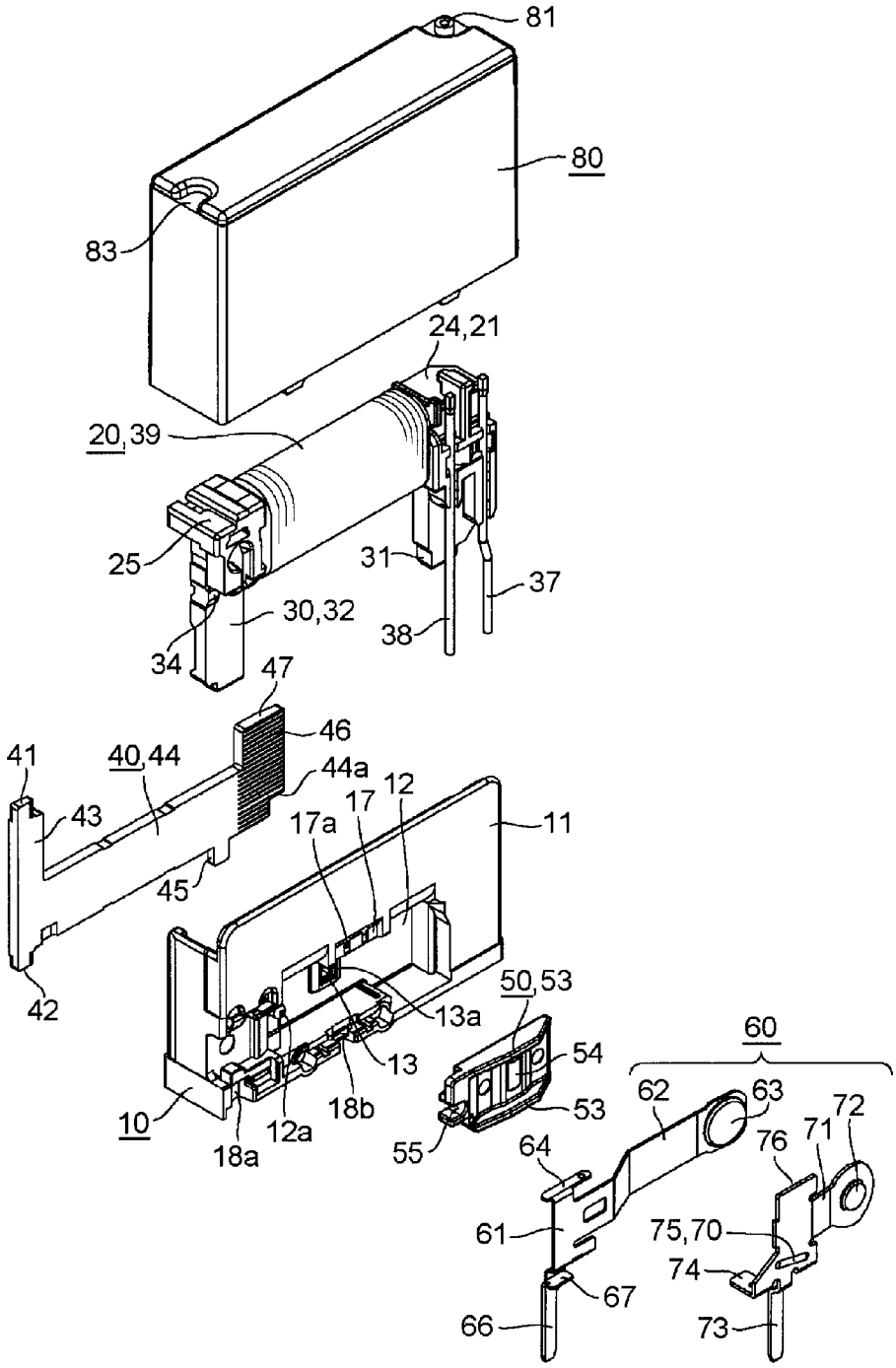
FIG. 3 is an exploded perspective view illustrating the electromagnetic relay from the same viewpoint as shown in FIG. 1B.

As illustrated in FIGS. 2 and 3, the movable iron piece 40 includes a turning shaft part 43 and an L-shape turning arm part 44. Shaft parts 41 and 42 are provided in upper and lower portions of the turning shaft part 43. The turning arm part 44 laterally extends from a lower half of the turning shaft part 43, and includes an extending part 47 that extends upward from a leading end part 44*a*. A retaining projection 45 is projected from a lower edge portion of the turning arm part 44, and many projected threads 46 are provided in parallel by the press working in the leading end part 44*a* on the rear surface side of the turning arm part 44. The projected thread 46 is provided to prevent fixing of the movable iron piece 40 and the gate type iron core 30, which is caused by an adhesive material generated by an arc. The turning arm part 44 is not necessarily formed into the L-shape, but the turning arm part 44 may have a shape in which the leading end part 44*a* of the turning arm part 44 is bent or a simple strip shape.

In the case where the electromagnetic part 20 and the movable iron piece 40 are assembled on the base 10, the shaft part 41 of the movable iron piece 40 is positioned in the bearing part 25*a* provided in the guard portion 25 of the spool 21, and the movable iron piece 40 is overlapped with the gate type iron core 30. Further, tip end portions of the leg parts 31 and 32 of the gate type iron core 30 are press-fitted in the press-fitting recessed portions 14 and 15 of the base 10 in order to crush the crush projections 14*a* and 15*a* which are provided in the press-fitting recessed portions 14 and 15. Therefore, the tip end portions of the leg parts 31 and 32 are pressed against and positioned in the press-fitting recessed portions 14 and 15, respectively (see FIG. 5B). Also the protrusion 34 provided in the gate type iron core 30 is fitted in a positioning recessed portion 11*a* (FIG. 2) which is provided in the insulating wall 11. The shaft part 42 of the movable iron piece 40 is turnably fitted in the bearing part 16*b* of the base 10, and the retaining projection 45 is fitted and retained in the retaining hole 16*a* of the base 10.

Figure 5C:
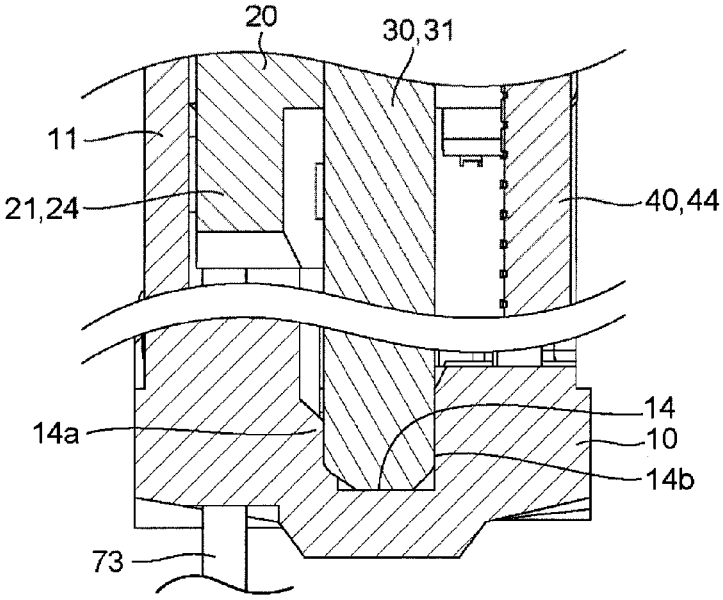
FIG. 5C is a partially enlarged view of FIG. 5A.
Figure 6A:
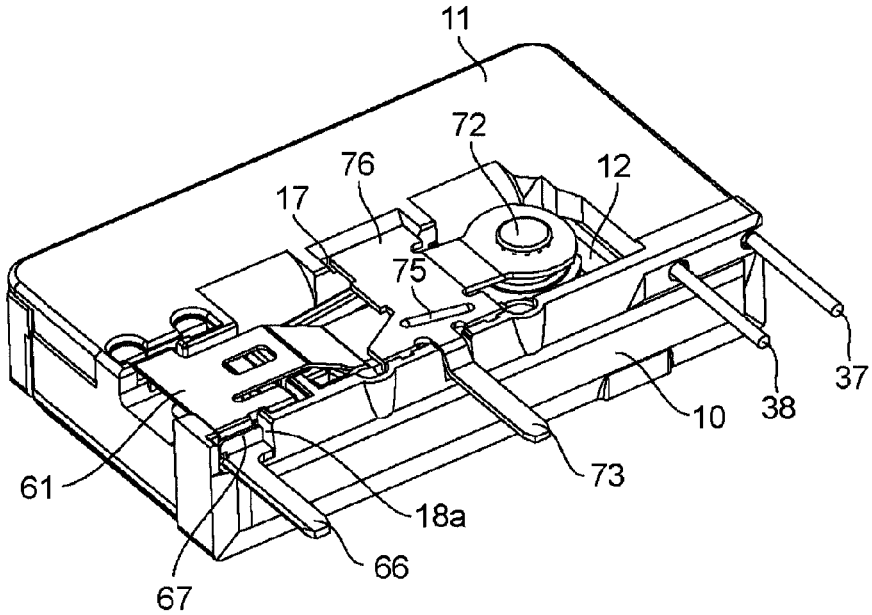
FIG. 6A is a top view of the electromagnetic relay as shown in FIG. 1B.
Figure 6B:
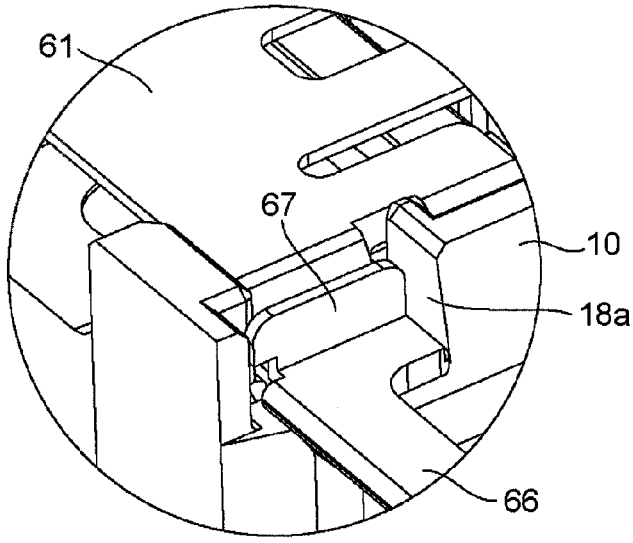
FIG. 6B is a partially enlarged view of FIG. 6A.
Figure 7A:
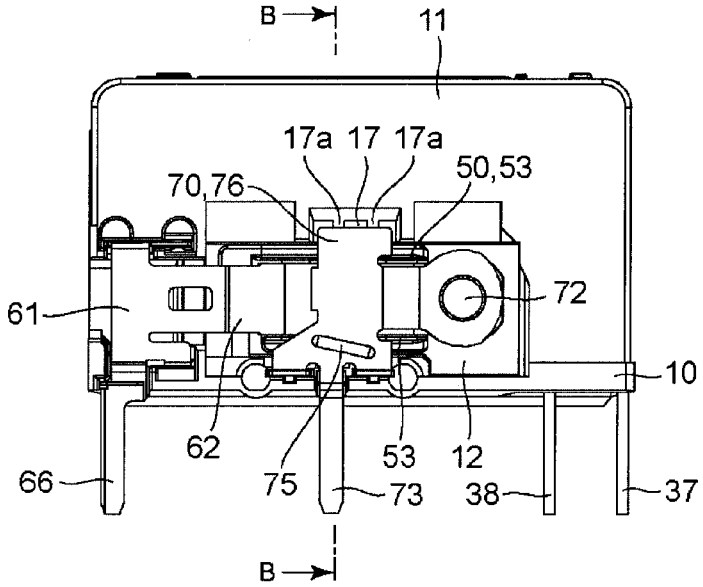
FIG. 7A is a front view of the electromagnetic relay as shown in FIG. 1B.
Figure 7B:
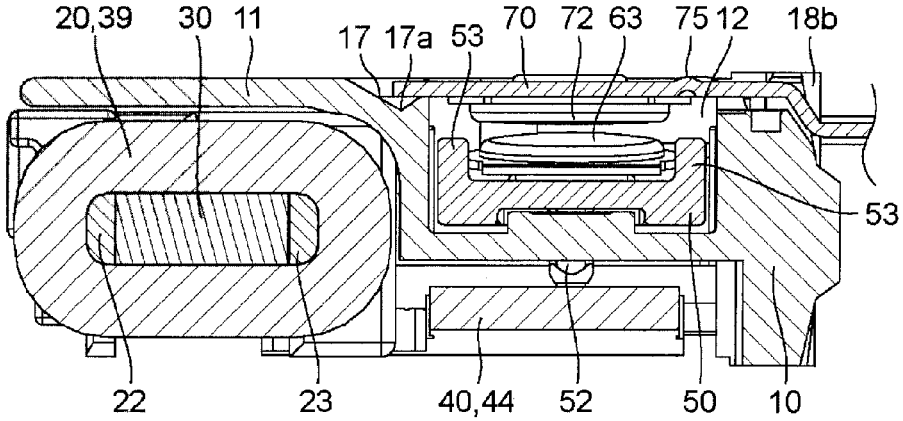
FIG. 7B is a partially enlarged sectional view of the electromagnetic relay taken on a line B-B of FIG. 7A.
Figure 7C:
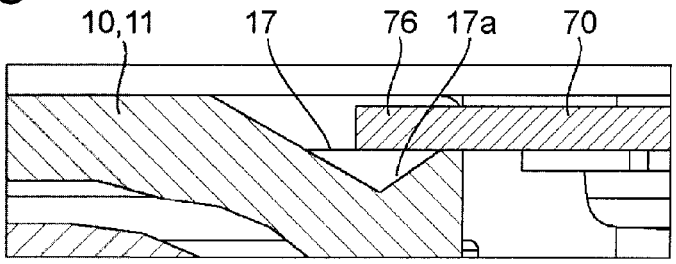
FIG. 7C is an enlarged view of a main portion of the electromagnetic relay, as shown in FIG. 7B.

In the case where the electromagnetic part 20 is assembled on the base 10, as illustrated in FIGS. 5A, 5B, and 5C, the guard portions 24 and 25 of the spool 21 does not abut on the insulating wall 11 of the base 10, but only the gate type iron core 30 abuts on the base 10. Therefore, because an assembly error of the electromagnetic part 20 with respect to the base 10 is decreased to enhance positioning accuracy of the electromagnetic part 20, advantageously a support strength can be ensured as designed, and the electromagnetic relay having a good operating characteristic is obtained.

Figure 4A:
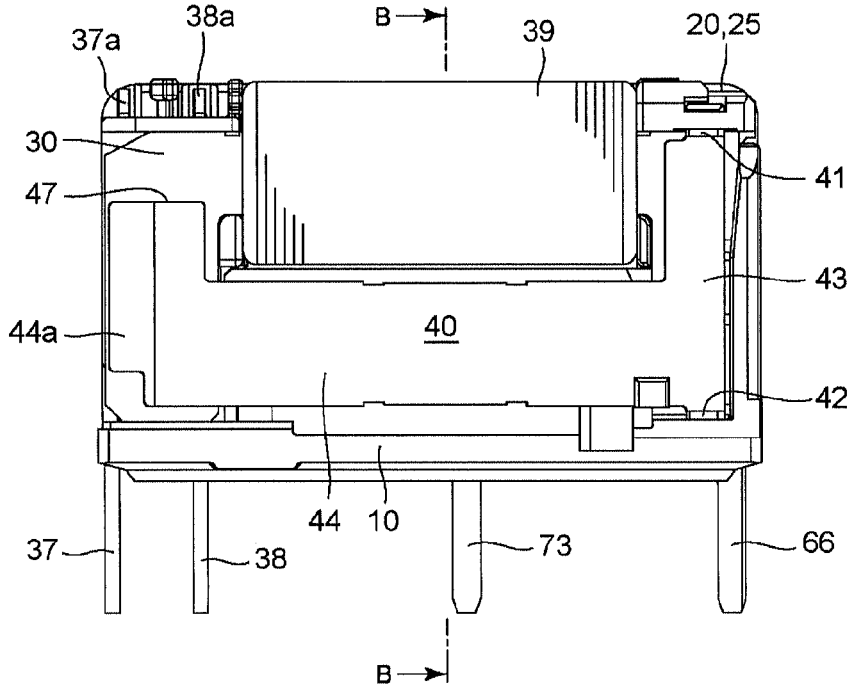
FIG. 4A is a front view of the electromagnetic relay as shown in FIG. 1A.
Figure 4B:
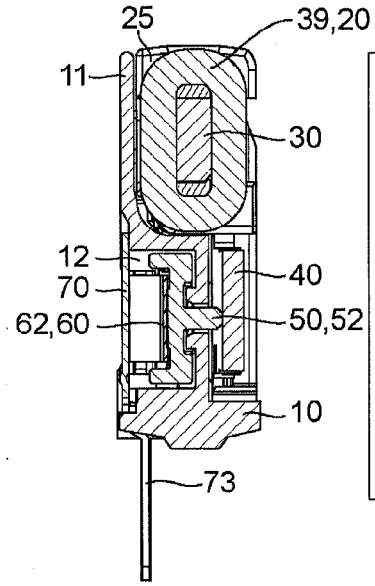
FIG. 4B is a sectional view of the electromagnetic relay taken on a line B-B of FIG. 4A.
Figure 4C:
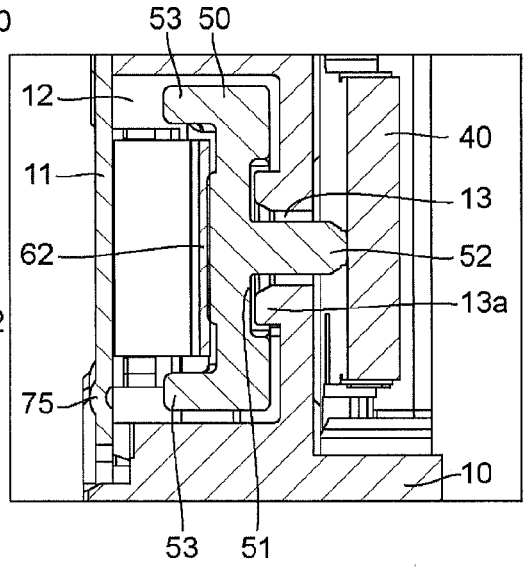
FIG. 4C is a partially enlarged view of FIG. 4B.
Figure 15A:
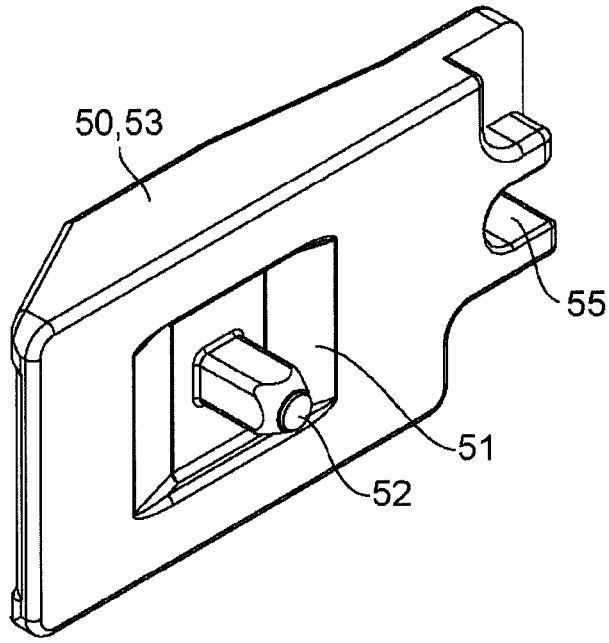
FIGS. 15A and 15B are perspective views of a card.
Figure 15B:
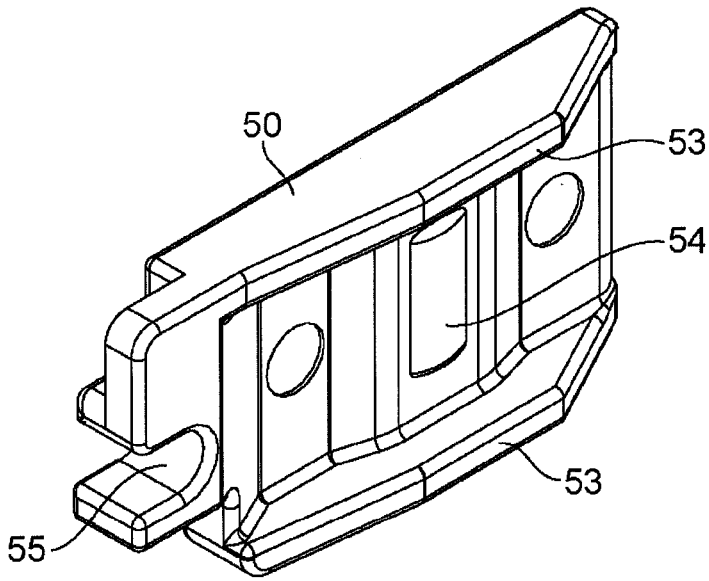

As illustrated in FIGS. 15A and 15B, the card 50 has the shape that can be accommodated in the recess 12 of the base 10, and the manipulation projection 52 is projected from a bottom surface of an insulating recessed portion 51 provided in the center on the front surface side of the card 50. The insulating recessed portion 51 has an outer-shape dimension that can be fitted in the square-shaped looped rib 13*a* of the base 10 (FIG. 4C). On the other hand, in the card 50, a pair of insulating ribs 53 and 53 is projected in the upper and the lower edge portions of the rear surface, and a projected thread 54 that abuts on a movable contact piece 62 is provided on the same axis as the manipulation projection 52. The insulating rib 53 partitions the upper and the lower edge portions of the movable contact piece 62 to lengthen an insulating distance (FIG. 4C). A notch part 55 that is fitted in the support projection 12*a* provided in the base 10 is provided in an edge portion on one side of the base 10. Accordingly, the manipulation hole 13 and support projection 12*a* of the base 10 can be assembled in the manipulation projection 52 and notch 55 of the card 50, respectively.

Figure 16B:
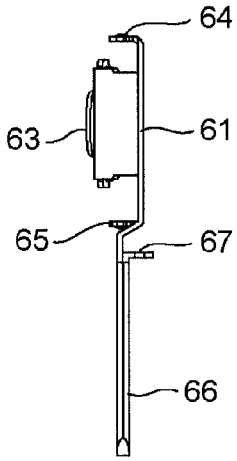
FIG. 16B is a left side view of the movable contact terminal.
Figure 16A:
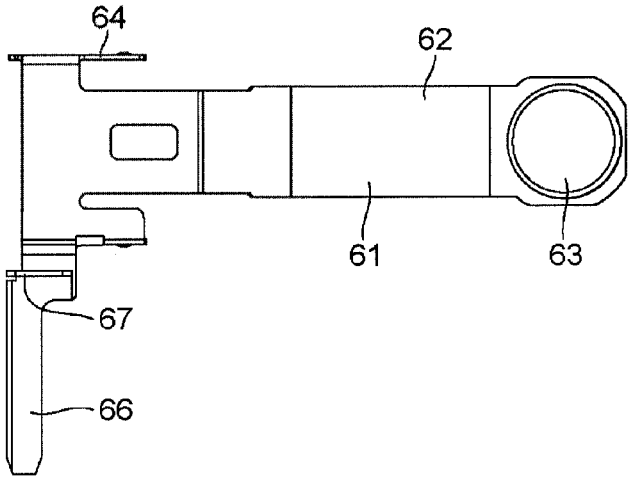
FIG. 16A is a front view of a movable contact terminal.
Figure 16C:
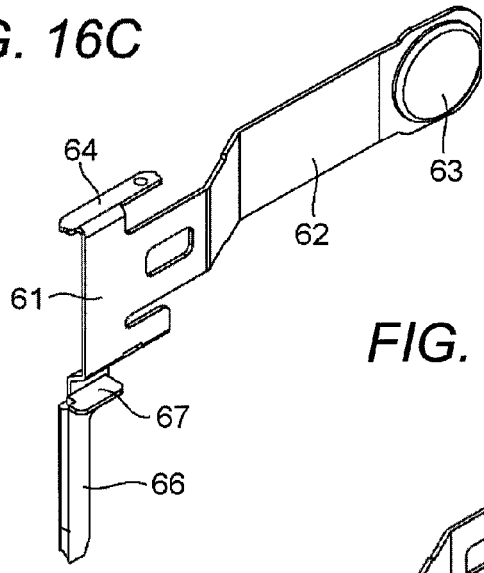
FIG. 16C is a perspective view of the movable contact terminal.
Figure 16D:
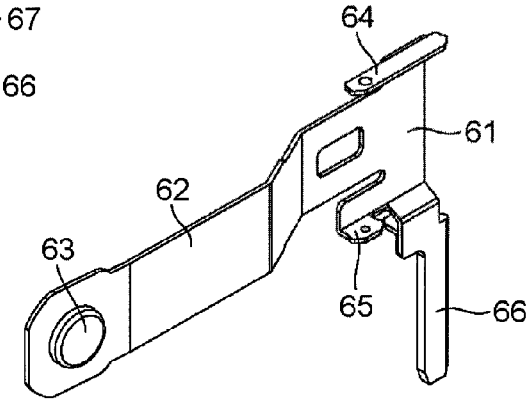
FIG. 16D is a perspective view of the movable contact terminal from a different angle.

As illustrated in FIGS. 2 and 3, the contact driving part 60 includes a movable contact terminal 61 and a fixed contact terminal 70. As illustrated in FIG. 16A, a movable contact 63 is caulked and fixed to a free end portion of the movable contact piece 62 that laterally extends from a side-surface edge portion of the movable contact terminal 61. In the base portion of the movable contact piece 62, a press-fitting tongue piece 64 is cut and raised from the upper edge portion, a press-fitting tongue piece 65 is cut and raised from the lower edge portion, and a terminal part 66 extends from the lower edge portion. In the terminal part 66, bent margins punched by the press working are folded into two and an upper-end edge portion of the bent margin is bent and raised to form a seal stopping part 67. In the movable contact piece 62, corner portions in the tip end portion are cut out, and the insulating distance from the fixed contact terminal 70 through the inner surface of the base 10 is lengthened to enhance the insulating characteristic.

The press-fitting tongue pieces 64 and 65 of the movable contact terminal 61 are press-fitted in the press fit grooves 19*a* and 19*b* of the base 10, and the base portion of the terminal part 66 of the movable contact terminal 61 is fitted in the movable contact terminal notch part 18*a* of the base 10. Therefore, the seal stopping part 67 of the movable contact terminal 61 closes the notch part 18*a* (FIG. 6B), and the movable contact piece 62 abuts on the projected thread 54 of the card 50.

Figure 17A:
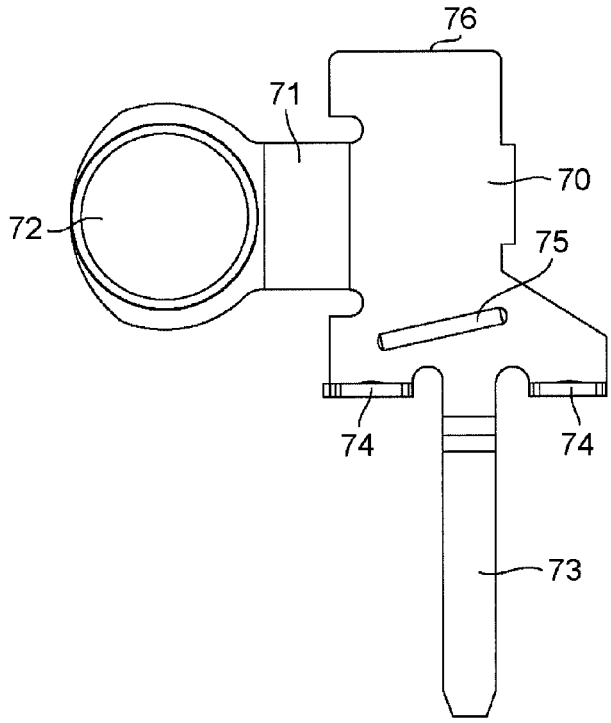
FIG. 17A is a front view of fixed contact terminal.
Figure 17B:
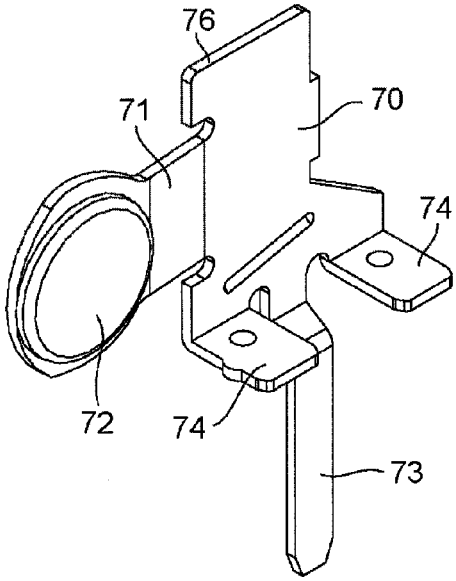
FIG. 17B is a perspective view of the fixed contact terminal.
Figure 17C:
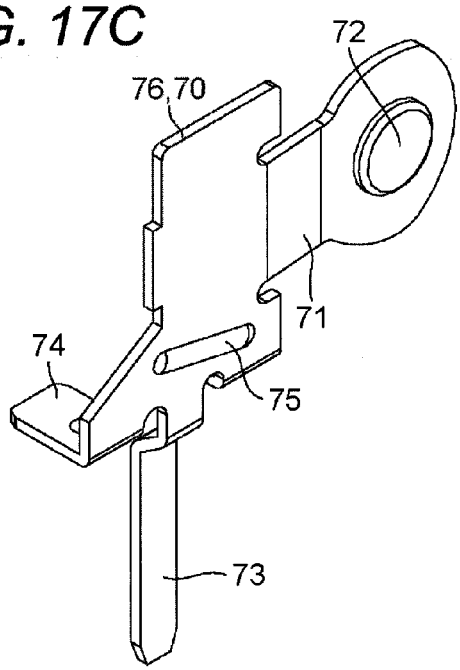
FIG. 17C is a perspective view illustrating the fixed contact terminal from a different angle.

As illustrated in FIG. 17A, in fixed contact terminal 70, a fixed contact 72 is caulked and fixed to a leading end portion of a fixed contact piece 71 that laterally extends from the side-surface edge portion, a terminal part 73 extends from a lower portion, and press-fitting ribs 74 and 74 are cut and raised from edge portions on both sides. A seal stopping part 75 is provided by knockout working on a back side in the base portion of the terminal part 73. A leading end portion of the fixed contact piece 71 is formed into an arc shape along an outer circumference of the fixed contact 72, and particularly the tip edge portion is cut off so as to be flash with the fixed contact 72. This is because the insulating distance from the movable contact terminal 61 through the inner surface of the base 10 and the insulating distance from the coil terminals 37 and 38 are lengthened to improve the insulating characteristic.

The press-fitting ribs 74 and 74 of the fixed contact terminal 70 are press-fitted in the press fit grooves 19*c* and 19*c* of the base 10, an upper end part 76 of the fixed contact terminal 70 is positioned in the positioning step part 17 provided in the insulating wall 11, and the base portion of the terminal part 73 is fitted in the fixed contact terminal notch part 18*b*. Then the seal material (not illustrated) is injected in the seal reservoir part 17*a* provided in the positioning step part 17 and solidified. Therefore, the fixed contact terminal 70 is fixed to the base 10, and the fixed contact 72 is opposed so as to be able to be brought into contact with and separated from the movable contact 63. Usually, the abrasion powder is generated by the opening and closing of the contact, and the abrasion powder adheres to and remains in the inner surface of the base 10, whereby an electric short circuit is easily generated between the fixed contact and the movable contact to degrade the insulation. On the other hand, according to the present invention, the leading end portion of the movable contact piece 62 and the leading end portion of the fixed contact piece 71 are cut off. Therefore, advantageously the insulating distance between the fixed contact 72 and the base 10 (the inner surface of the recess 12) or the insulating distance between the movable contact 63 and the base 10 (the inner surface of the recess 12) can be lengthened to prevent the degradation of the insulation.

Figure 18:
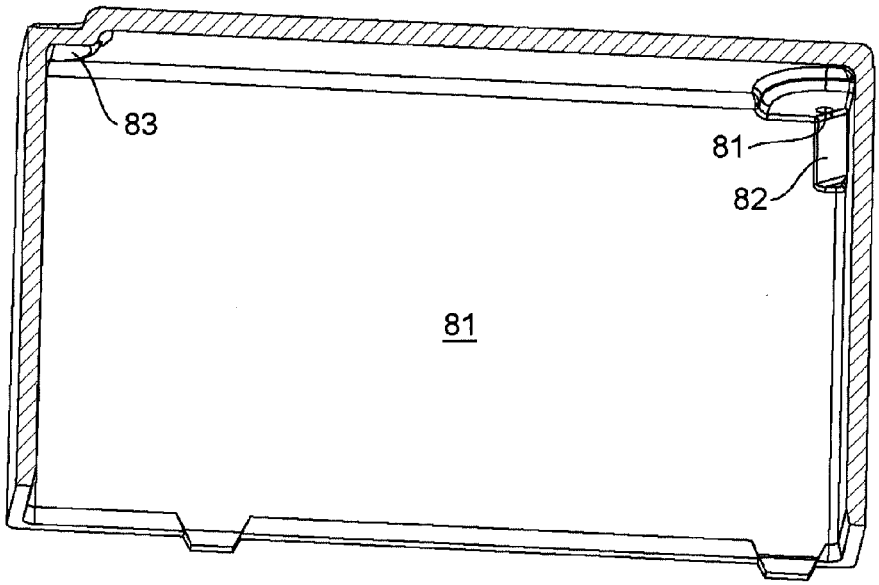
FIG. 18 is a sectional perspective view of a case.

As illustrated in FIGS. 2 and 3, the case 80 has a box shape that can be fitted on the base 10, and a hole 81 is made in a corner portion of the upper surface of the case 80. As illustrated in FIG. 18, a positioning projected thread 82 is integrally molded in the corner portion of the ceiling surface of the case 80.

The positioning projected thread 82 abuts on a tapered part 21*a* (FIG. 1) of the spool 21 to prevent false insertion. The case 80 also includes a step part 83 in the corner portion on a short-side side of the ceiling surface in order to avoid a trouble caused by a gate in the molding.

After the case 80 is fitted on the base 10 in which the internal components are assembled, the seal material (not illustrated) is injected in the bottom surface of the base 10 and solidified and sealed. When the case 80 is fitted on the base 10, the seal stopping part 75 of the fixed contact terminal 70 is located near the inside surface of the case 80. Therefore, the seal stopping part 67 provided in the movable contact terminal 61 and the seal stopping part 75 provided in the fixed contact terminal 70 prevent the invasion of the seal material, and the generation of the operating failure or contact failure can be prevented. Then the hole 81 of the case 80 is thermally sealed to complete the assembly work.

Figure 13A:
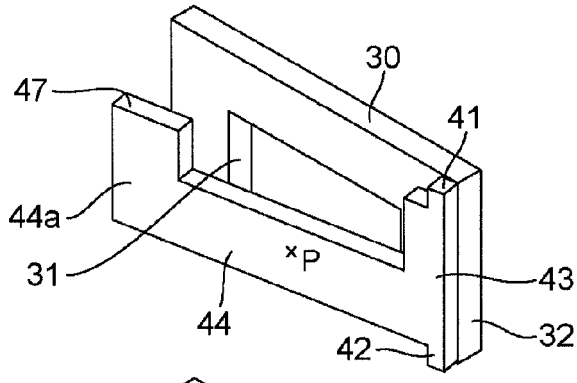
FIGS. 13A to 13D are perspective views illustrating an operation of the movable iron piece.
Figure 13B:
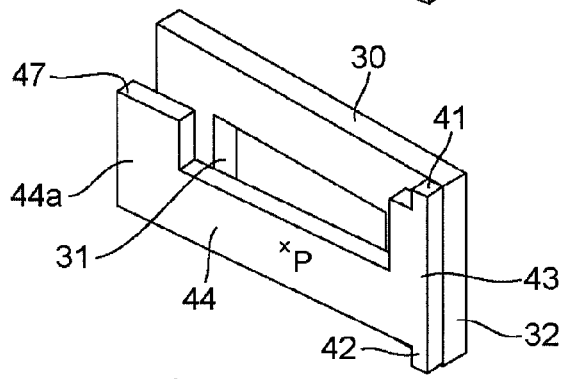

Subsequently, an operation of the electromagnetic relay according to the present invention will be described below. In the case where a voltage is not applied to the coil 39 of the electromagnetic part 20, the card 50 is biased toward the side of the insulating wall 11 by a spring force of the movable contact piece 62, the movable contact 63 is separated from the fixed contact 72, and the leading end part 44*a* of the turning arm part 44 of the movable iron piece 40 is separated from the gate type iron core 30 (FIG. 13A).

Figure 13C:
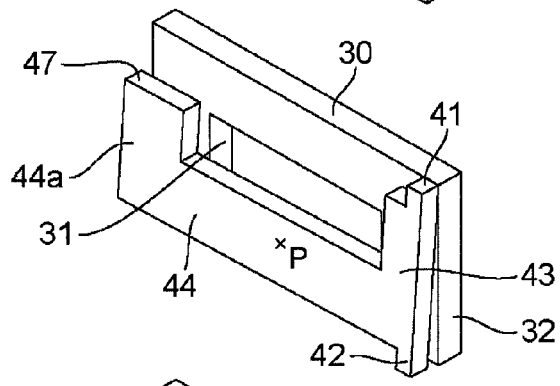
Figure 13D:
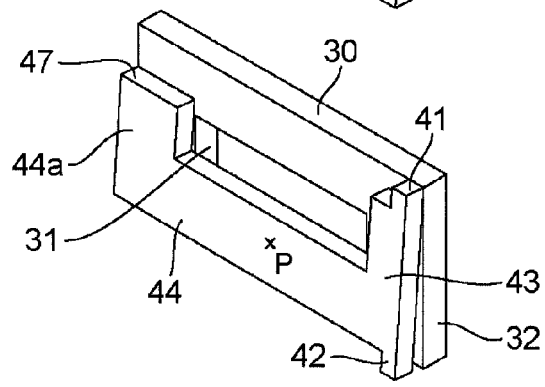

When the voltage is applied to the coil 39 of the electromagnetic part 20 in order to excite the coil 39, the leading end part 44*a* of the turning arm part 44 of the movable iron piece 40 is attracted, and the movable iron piece 40 turns about the shaft parts 41 and 42. When the turning arm part 44 pushes the manipulation projection 52 of the card 50 at the pressing point P (FIG. 13B), torsion moment acts about the line connecting the shaft part 41 and the pressing point P. Therefore, while the shaft part 42 is separated from the gate type iron core 30, the tip edge portion of the extended part 47 extending from the leading end part 44*a* of the movable iron piece 40 comes close to the gate type iron core 30 (FIG. 13C). Then the tip edge portion of the extending part 47 is attracted to the gate type iron core 30 and becomes a stable state (FIG. 13D). As a result, the card 50 is pushed into a final position, and the movable contact 63 of the movable contact piece 62 displaced in a plate-thickness direction comes into contact with the fixed contact 72.

In the first embodiment, since the shallow groove 33 that is of the magnetic flux density reducing part is provided in the lower portion of the leg part 32 of the gate type iron core 30, a magnetic resistance is increased to decrease the magnetic flux density. Therefore, when the torsion moment acts on the movable iron piece 40, the shaft part 42 of the movable iron piece 40 is separated from the gate type iron core 30 at an initial stage of a stroke. As a result, advantageously a variation in operating voltage is eliminated, and the electromagnetic relay having the stable operating characteristic is obtained. The part that reduces the magnetic flux density is not limited to the shallow groove 33. For example, a projection may be provided, or the part that reduces the magnetic flux density may be constructed by a magnetic shielding plate or a copper-plating non-magnetic material. The part that reduces the magnetic flux density may be provided in both or one of the gate type iron core 30 and the movable iron piece 40. The part that reduces the magnetic flux density may be provided by combining the shallow groove 33, the projection, the magnetic shielding plate, and the non-magnetic material. For example, the part that reduces the magnetic flux density may be constructed by providing the shallow groove 33 and the non-magnetic material in the gate type iron core 30.

When the application of the voltage to the coil 39 is stopped, the card 50 is pushed back by the spring force of the movable contact piece 62, and the manipulation projection 52 of the card 50 pushes back the turning arm part 44 of the movable iron piece 40 to return to the original state.

Figure 19A:
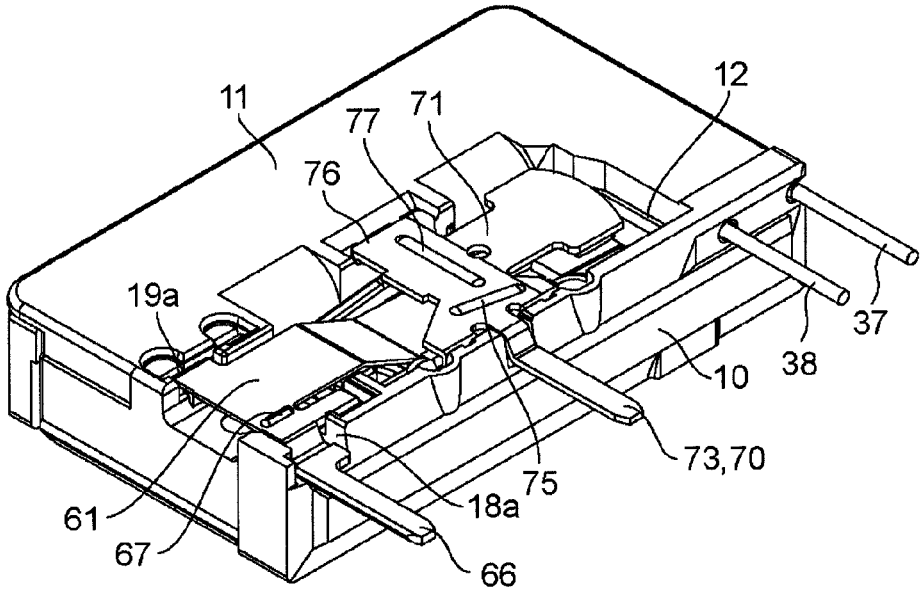
FIG. 19A is a perspective view of an electromagnetic relay according to second preferred embodiment of the present invention.
Figure 19B:
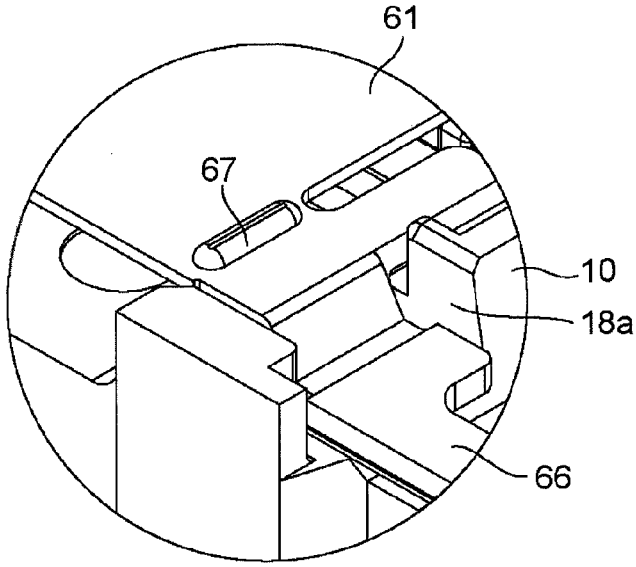
FIG. 19B is a partially enlarged perspective view of the electromagnetic relay as shown in FIG. 19A.

As illustrated in FIGS. 19A and 19B, according to the second embodiment of the present invention, the seal stopping part 67 is formed by knockout working on the back side in the base portion of the terminal part 66 of the movable contact terminal 61, and a reinforcing projected thread 77 is formed in the fixed contact terminal 70 by the knockout working. According to the second embodiment, advantageously a yield ratio of the material is improved, and the electromagnetic relay is easily produced. Because other configurations are identical to those of the previously discussed embodiment, the same component is designated by the same numeral and the description is omitted for sake of brevity.

Figure 20A:
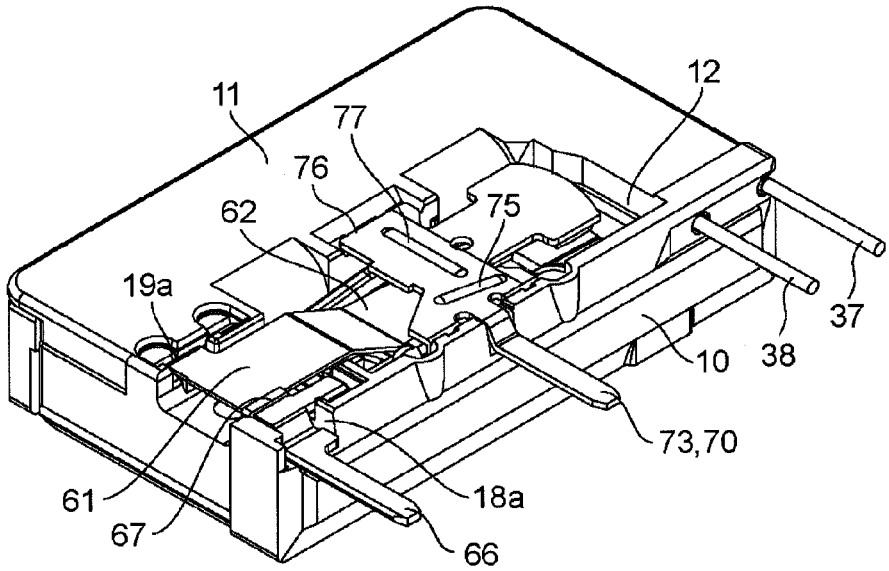
FIG. 20A is a perspective view of an electromagnetic relay according to third preferred embodiment of the present invention.
Figure 20B:
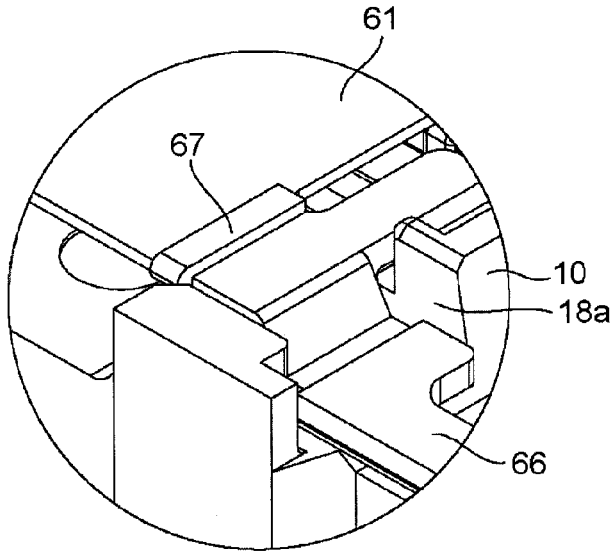
FIG. 20B is a partially enlarged perspective view of the electromagnetic relay as shown in FIG. 20A.

As illustrated in FIGS. 20A and 20B, according to the third embodiment of the present invention, the seal stopping part 67 is formed by cutting and bending the back-side edge portion in the base portion of the terminal part 66 of the movable contact terminal 61. According to the third embodiment, advantageously the long seal stopping part 67 is brought close to the inside surface of the case 80, and the invasion of the seal material can more surely be prevented. For sake of conciseness further detailed description is omitted here because other configurations are identical to those of the previously discussed embodiments and, the same component is designated by the same numeral.

Figure 21A:
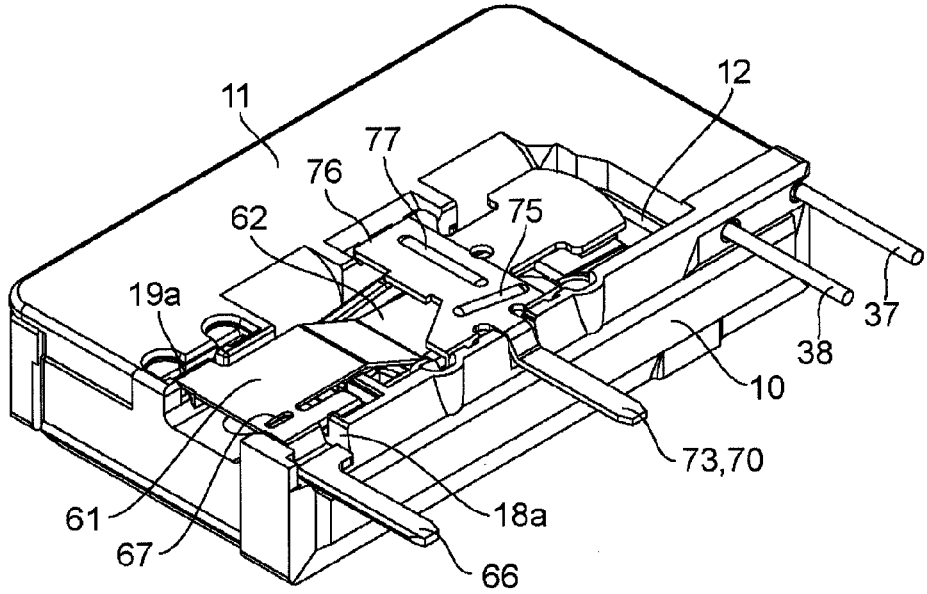
FIG. 21A is a perspective view of an electromagnetic relay according to fourth preferred embodiment of the present invention.
Figure 21B:
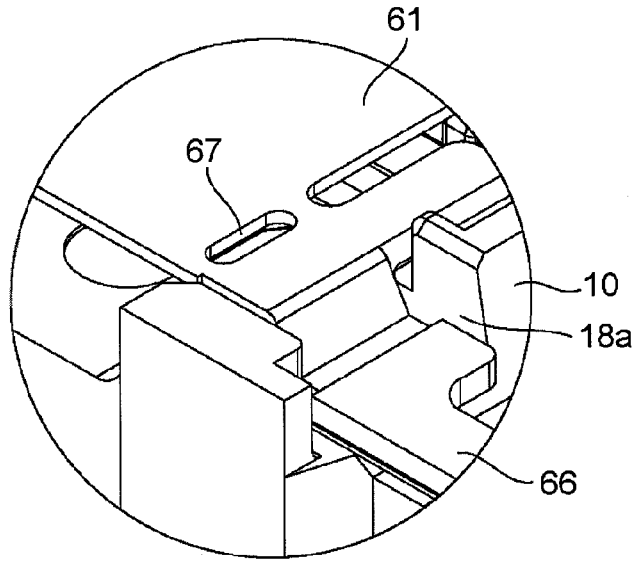
FIG. 21B is a partially enlarged perspective view of the electromagnetic relay as shown in FIG. 21A.

As illustrated in FIGS. 21A and 21B, according to the fourth embodiment of the present invention, a through-hole that is of the seal stopping part 67 is made by punching on the back side in the base portion of the terminal part 66 of the movable contact terminal 61. According to the fourth embodiment, advantageously the yield ratio of the material is improved, and the electromagnetic relay is easily produced.

Figure 22A:
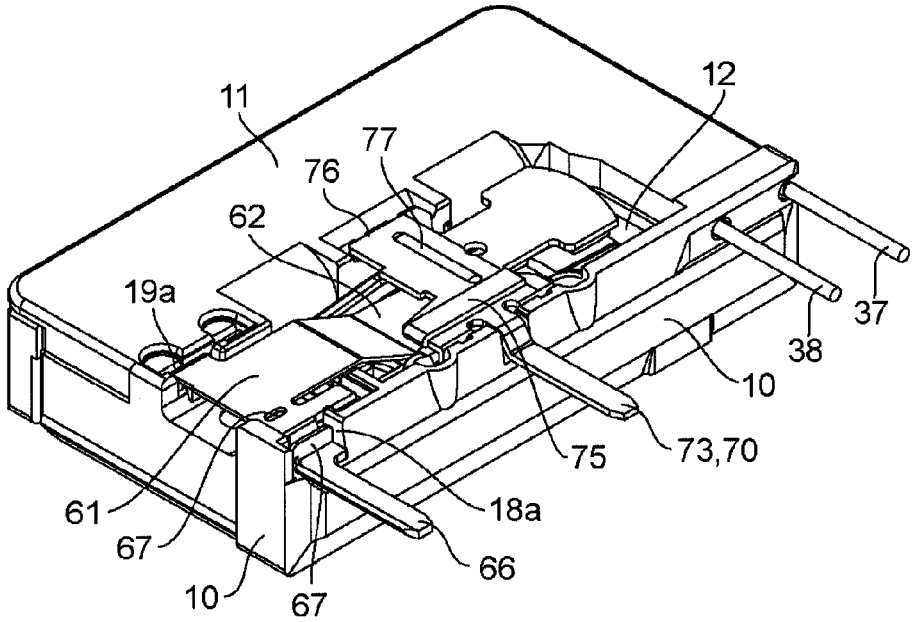
FIG. 22A is a perspective view of an electromagnetic relay according to fifth preferred embodiment of the present invention.
Figure 22B:
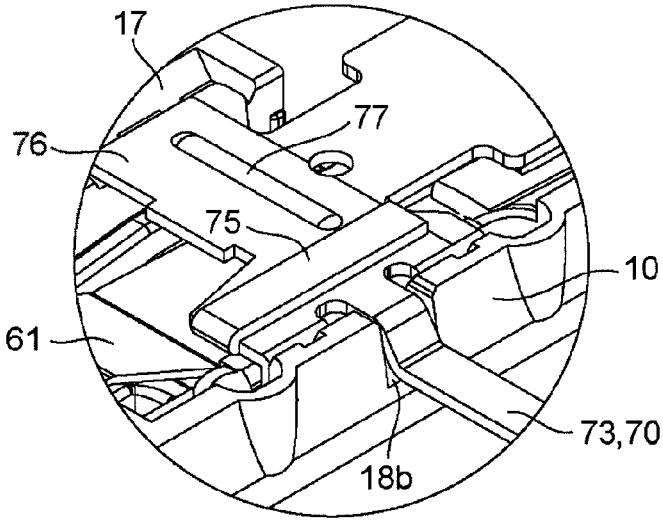
FIG. 22B is a partially enlarged perspective view of the electromagnetic relay as shown in FIG. 22A.
Figure 23A:
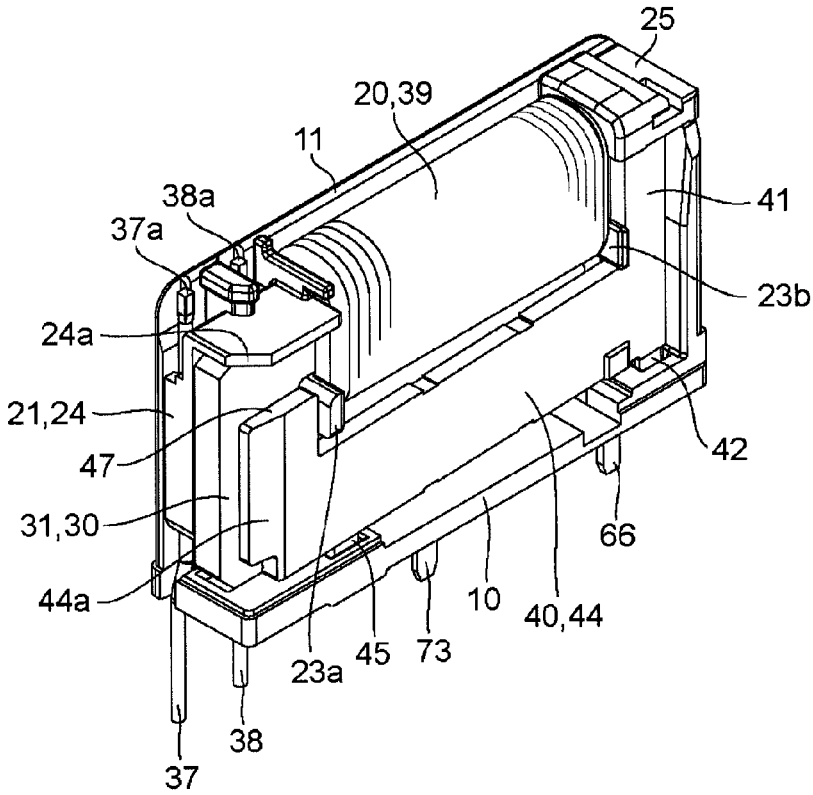
FIG. 23A is a perspective view of an electromagnetic relay according to sixth preferred embodiment of the present invention.
Figure 23B:
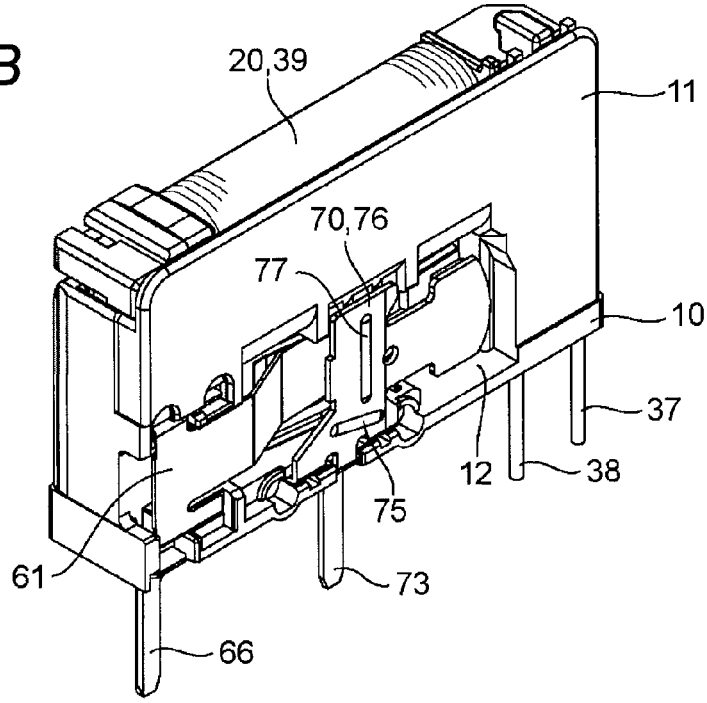
FIG. 23B is a perspective view of the electromagnetic relay, as shown in FIG. 23A, from a different angle.

As illustrated in FIGS. 22A and 22B, according to the fifth embodiment of the present invention, a long seal stopping part 75 brought close to the inside surface of the case 80 is formed by cutting and bending the edge portion on the back side of the base portion of the terminal part 73 provided in the fixed contact terminal 70. According to the fifth embodiment, advantageously the long seal stopping part 67 is brought close to the inside surface of the case 80, and the invasion of the seal material can more surely be prevented.

Figure 24:
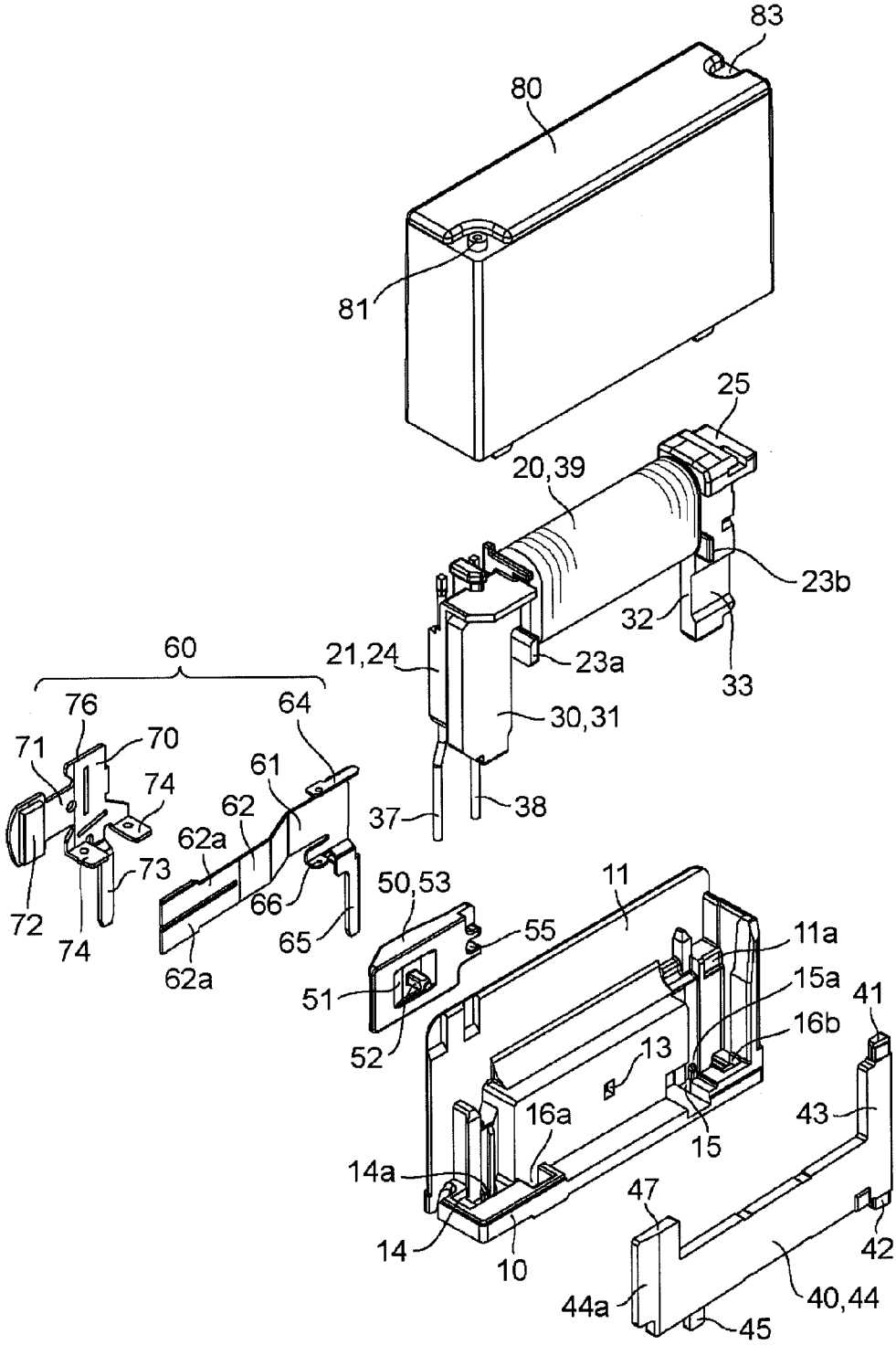
FIG. 24 is an exploded perspective view of the electromagnetic relay of the sixth embodiment from the same viewpoint as shown in FIG. 23A.
Figure 25:
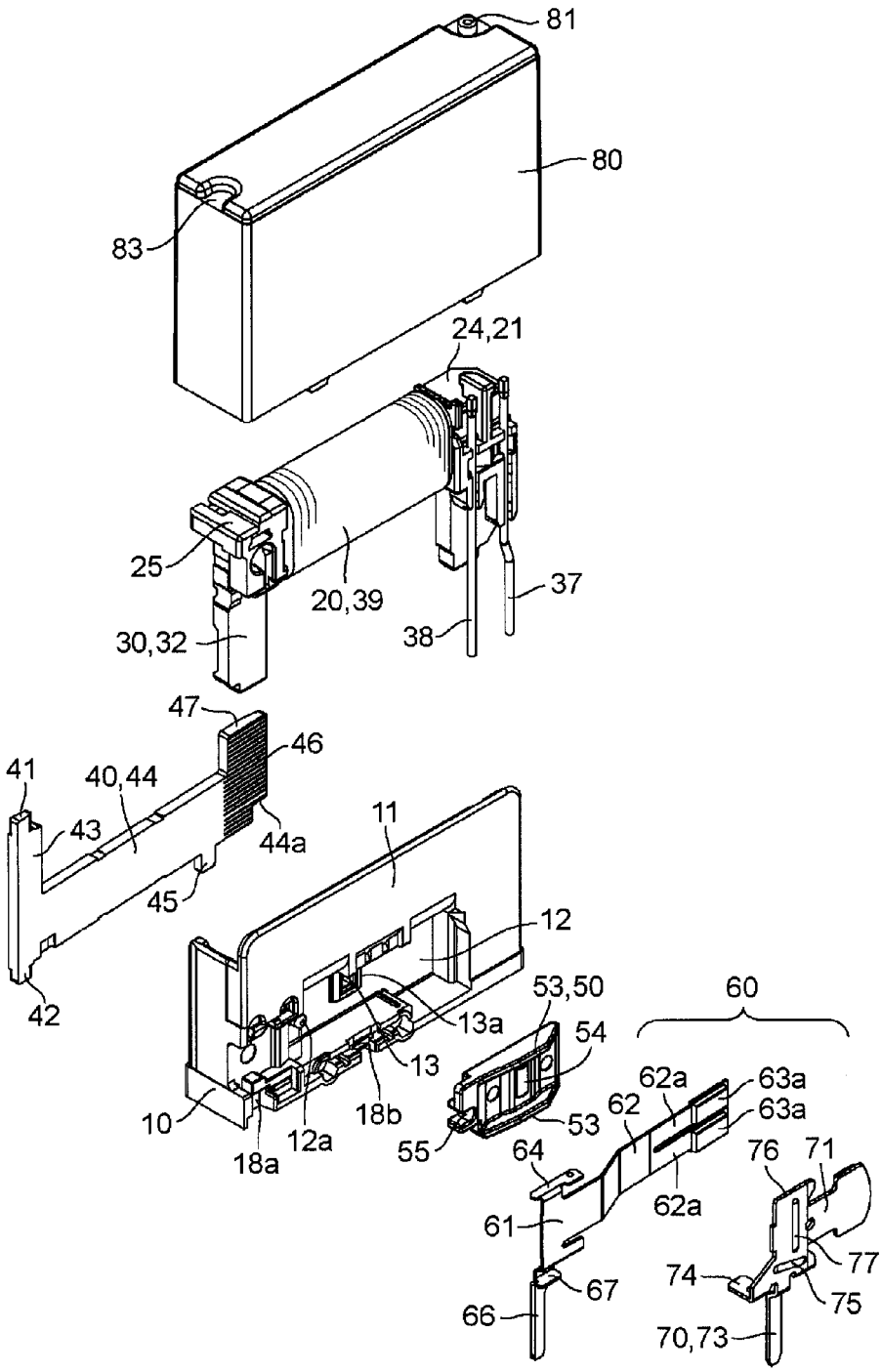
FIG. 25 is an exploded perspective view of the electromagnetic relay of the sixth embodiment from the same viewpoint as shown in FIG. 23B.

As illustrated in FIGS. 23A, 23B, 24 and 25, according to the sixth embodiment of the present invention differs from the first embodiment in a twin contact structure. That is, as illustrated in FIGS. 24 and 25, the leading end portion of the movable contact piece 62 is divided into two in a width direction to provide divided pieces 62*a* and 62*a*, and movable contacts 63*a* are provided in free end portions of the divided pieces 62*a*, respectively. On the other hand, the rod-shaped fixed contact 72 is provided in the free end portion of the fixed contact piece 71 to form a cross-bar contact structure. According to the sixth embodiment, advantageously the electromagnetic relay having high contact reliability is obtained. Because other configurations are identical to those of the previously discussed embodiments, the same component is designated by the same numeral and the description is omitted.

EXAMPLE 1

Figure 14A:
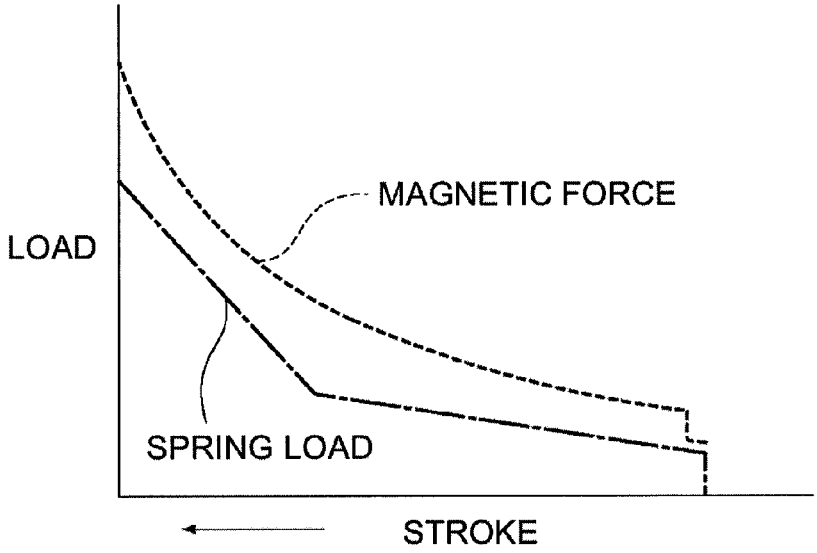
FIGS. 14A and 14B are graphical representation of a relationship between a spring load acting on a pressing point P and a magnetic force generated by a coil.
Figure 14B:
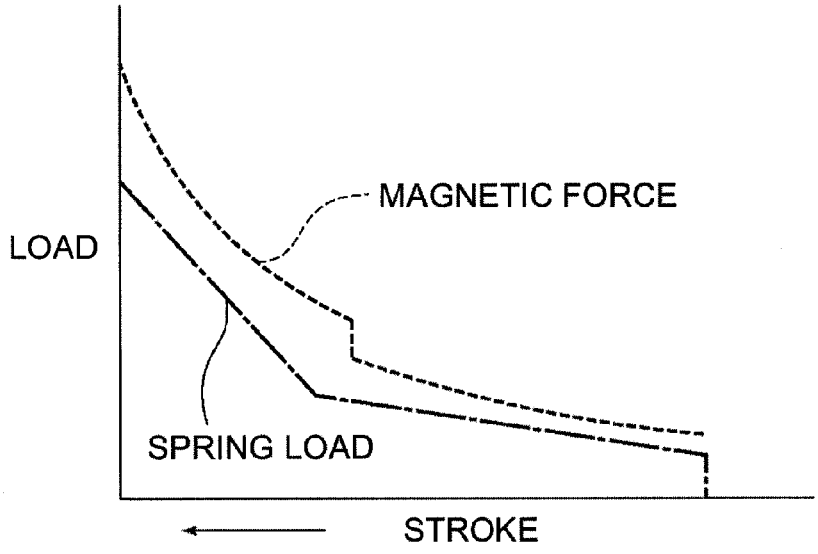

A magnetic characteristic of the electromagnetic relay of an example 1 was measured. FIG. 14A illustrates a measurement result. On the other hand, the magnetic characteristic of the conventional electromagnetic relay was similarly measured. FIG. 14B illustrates the measurement result of the conventional electromagnetic relay. In graphs in FIGS. 14A and 14B, a vertical axis indicates a load applied to the pressing point P, and a horizontal axis indicates the stroke that is of a movement amount of the card. The right end side of the graph indicates the state in which the voltage is not applied to the coil, namely, the state in which the card is not moved. The graph indicates the state in which toward the left side of the graph, the voltage is applied to the coil to move the card.

In the present invention, the shaft part 42 of the movable iron piece 40 is separated from the leg part 32 of the gate type iron core 30, and the tip edge portion of the extending part 47 comes close to the leg part 31 of the gate type iron core 30 (FIG. 13C). Therefore, as is clear from a dotted line in FIG. 14A, the magnetic force generated by the coil is rapidly increased at the initial stage of the stroke. On the other hand, in the conventional example, in FIG. 14B, a point at which the magnetic force is rapidly increased is delayed. That is, in the present invention, the shaft part 42 of the movable iron piece 40 is easily separated from the leg part 32 of the gate type iron core 30 by providing the magnetic flux density reducing part, so that the magnetic force can rapidly be increased at the initial stage of the stroke. As a result, the variation in operating voltage can be prevented, and the electromagnetic relay having the stable operating characteristic is obtained. When the point at which the magnetic force is rapidly increased is excessively delayed, an alternate-long-and-short-dash-line spring load acting on the pressing point P becomes larger than the magnetic force of the coil, and an inoperative risk is generated. Therefore, the invention also has an effect to prevent the inoperative risk.

The electromagnetic relay of the present invention can be applied not only to the above-described electromagnetic relay but also to other electromagnetic relays.

There has thus been shown and described an electromagnetic relay which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An electromagnetic relay comprising:

an electromagnetic part;

a movable iron piece;

a contact driving part;

a contact selectively openable and closeable by driving the contact driving part with a card disposed between the movable iron piece and the contact driving part; a driving projection projected onto an inward surface side of the card, the driving projection insertable into a manipulation hole made in an insulating wall, projecting from an upper surface of a base;

insulating ribs provided in an upper and a lower edge portion on an outward surface side that is located on an opposite side to the insulating wall of the card;

wherein the electromagnetic part and the movable iron piece are disposed on one side of the insulating wall and the contact driving part is disposed on the other side of the insulating wall;

wherein the card is disposed between the insulating wall and the contact driving part, and wherein the driving projection of the card is pressed by the movable iron piece operable based on excitation and demagnetization of the electromagnetic part.

2. The electromagnetic relay according to claim 1, further comprising a looped rib provided in an opening edge of the manipulation hole on the other side of the insulating wall.

3. The electromagnetic relay according to claim 2, further comprising a looped groove portion formed on the inward surface side of the card, wherein said looped groove portion is fixable in the looped rib.

4. An electromagnetic relay comprising:

an electromagnetic part;

a movable iron piece;

a contact driving part;

a contact selectively openable and closeable by driving the contact driving part with a card disposed between the movable iron piece and the contact driving part; a driving projection projected onto an inward surface side of the card, the driving projection insertable into a manipulation hole made in an insulating wall, projecting from an er surface of a base;

a notch provided in one edge portion of the card, fixable in a support projection projecting from the insulating wall of the base;

wherein the electromagnetic part and the movable iron piece are disposed on one side of the insulating wall and the contact driving part is disposed on the other side of the insulating wall;

wherein the card is disposed between the insulating wall and the contact driving part, and wherein the driving projection of the card is pressed by the movable iron piece operable based on excitation and demagnetization of the electromagnetic part.

5. The electromagnetic relay according to claim 2, further comprising a notch provided in one edge portion of the card, fixable in a support projection projecting from the insulating wall of the base.

6. The electromagnetic relay according to claim 3, further comprising a notch provided in one edge portion of the card, fixable in a support projection projecting from the insulating wall of the base.

7. The electromagnetic relay according to claim 1, further comprising a notch provided in one edge portion of the card, fixable in a support projection projecting from the insulating wall of the base.

* * * * *

UNITED STATES PATENT AND TRADEMARK OFFICE

CERTIFICATE OF CORRECTION

PATENT NO. : 8,922,307 B2
APPLICATION NO. : 13/859640
DATED : December 30, 2014
INVENTOR(S) : Koji Fujimoto et al.

It is certified that error appears in the above-identified patent and that said Letters Patent is hereby corrected as shown below:

In the Claims,

Column 12, Claim 4, line 11, please delete "er" and insert --upper--.

Signed and Sealed this
Fourth Day of August, 2015

Michelle K. Lee

Michelle K. Lee
*Director of the United States Patent and Trademark Office*